US006056523A

United States Patent [19]

Won et al.

[11] Patent Number: 6,056,523

[45] Date of Patent: May 2, 2000

[54] SCROLL-TYPE COMPRESSOR HAVING SECURING BLOCKS AND MULTIPLE DISCHARGE PORTS

[75] Inventors: Hiun Won, Seoul; Do Sig Choi, An Young; Jae Kil Shim, Kyungki-Do; Young Hun Cho, Chunan Chong Nam, all of Rep. of Korea

[73] Assignee: Kyungwon-Century Co., Ltd., Seoul, Rep. of Korea

[21] Appl. No.: 08/796,220

[22] Filed: Feb. 7, 1997

[30] Foreign Application Priority Data

| | | | |
|---|---|---|---|
| Feb. 9, 1996 | [KR] | Rep. of Korea | 96-3222 |
| Feb. 12, 1996 | [KR] | Rep. of Korea | 96-3348 |

[51] Int. Cl.[7] ..... F04C 18/04

[52] U.S. Cl. ..... 418/15; 418/55.1; 418/55.2; 418/55.4; 418/55.5; 418/57

[58] Field of Search ..... 418/15, 55.1, 55.2, 418/55.4, 55.5, 57

[56] References Cited

U.S. PATENT DOCUMENTS

| | | | |
|---|---|---|---|
| 3,600,114 | 8/1971 | Dvorak et al. | 418/55.2 |
| 3,874,827 | 4/1975 | Young | 418/55.5 |
| 3,884,599 | 5/1975 | Young et al. | 418/55.5 |
| 3,924,977 | 12/1975 | McCulloguh | 418/55.5 |
| 4,216,661 | 8/1980 | Tojo et al. | 62/505 |
| 4,475,360 | 10/1984 | Suefuji et al. | 62/324.1 |
| 4,496,296 | 1/1985 | Arai et al. | 418/55.5 |
| 4,505,651 | 3/1985 | Terauchi et al. | 417/440 |
| 4,585,403 | 4/1986 | Inaba et al. | 418/55.5 |
| 4,609,334 | 9/1986 | Muir et al. | 418/57 |
| 4,764,096 | 8/1988 | Sawai et al. | 418/55.5 |
| 4,767,293 | 8/1988 | Caillat et al. | 418/55.5 |
| 4,818,195 | 4/1989 | Murayama et al. | 418/55.1 |
| 4,854,831 | 8/1989 | Etemad et al. | 418/15 |
| 4,877,382 | 10/1989 | Caillat et al. | 418/55.5 |
| 5,037,278 | 8/1991 | Fujio et al. | 418/55.2 |
| 5,141,421 | 8/1992 | Bush et al. | 418/55.3 |
| 5,156,539 | 10/1992 | Anderson et al. | 418/55.4 |
| 5,192,202 | 3/1993 | Lee | 418/55.5 |
| 5,267,844 | 12/1993 | Grassbaugh et al. | 418/55.1 |
| 5,342,185 | 8/1994 | Anderson | 418/55.5 |
| 5,411,384 | 5/1995 | Bass et al. | 418/55.5 |
| 5,458,471 | 10/1995 | Ni | 418/55.5 |
| 5,474,433 | 12/1995 | Chang et al. | 418/55.5 |
| 5,551,851 | 9/1996 | Williams et al. | 418/55.5 |
| 5,582,513 | 12/1996 | Shigeoka et al. | 418/55.5 |
| 5,674,061 | 10/1997 | Motegi et al. | 418/55.4 |

FOREIGN PATENT DOCUMENTS

| | | | |
|---|---|---|---|
| 61-40472 | 2/1986 | Japan | 418/55.1 |
| 61-98987 | 5/1986 | Japan | 418/55.5 |
| 4-60188 | 2/1992 | Japan | 418/55.5 |
| 6-26471 | 2/1994 | Japan | 418/55.5 |
| 6-93982 | 4/1994 | Japan | 418/55.1 |
| 1717866 | 3/1992 | Russian Federation | 418/15 |

*Primary Examiner*—John J. Vrablik

*Attorney, Agent, or Firm*—Finnegan, Henderson, Farabow, Garrett & Dunner, L.L.P.

[57] ABSTRACT

A scroll-type compressor has multiple discharge ports and blocks to prevent undesired movement of the non-orbiting scroll plate and an improved lubrication system.

13 Claims, 26 Drawing Sheets

SCROLL-TYPE COMPRESSOR HAVING SECURING BLOCKS AND MULTIPLE DISCHARGE PORTS

BACKGROUND OF THE INVENTION

1. Field of the Invention

This invention relates to compressors, and more particularly to a scroll-type compressor configuration that is easily assembled and improves the efficiency and other performance characteristics of scroll-type compressors.

2. Description of the Related Art

A scroll-type compressor is a high efficiency compressor used in air conditioning systems, vacuum pumps, expanders, and engines. An example of a conventional scroll-type compressor configuration is illustrated in FIGS. 37 and 38. The scroll compressor comprises a hermetic casing, a shaft 10', a fixed scroll plate 20', orbiting scroll plate 14', and upper frame 4'. Each scroll plate 20' and 14' has a spiral shaped wrap 21' and 15', respectively. These wraps interfit to form an interior space and a series of crescent shaped pockets. A pressure equalizing passage 106' is formed in the orbiting scroll plate to interconnect the interior space with back-pressure pocket 58' of air bushing 3.

The orbiting scroll wrap 15' is rotationally displaced 180° relative to the stationary scroll wrap 21'. An orbiting movement is imparted to the orbiting scroll 14' by an Oldham's coupling 5 fitted into an upper frame 4'. The Oldham's coupling 5 translates rotational movement, e.g., from a rotating shaft 10', to an orbiting movement. A typical orbiting scroll will orbit at about 3600 rpm. As the orbiting scroll 14' orbits around the stationary plate 20', line contacts created between the interfitted wraps form crescent shaped pockets which begin to move radially inwards towards the center of the plates. As the crescent shaped pockets move radially inwards they reduce in volume, and therefore compress the fluid contained within the pockets. A discharge port at the center of one of the plates receives high pressure from the crescent shaped pockets when they terminate at the center. By this process, low pressure fluid is introduced at the exterior perimeter of the plates and is encased within the crescent shaped pockets as the pockets begin to form. As the pockets move inwardly, the fluid pressure increases until the fluid is discharged through the discharge port.

The scroll-type compressor has many advantages over other compressors, such as reciprocating compressors. First, the continuous movement of the scroll-type compressor does not require recompression or re-expansion. Second, the continuous and smooth operation of the scroll-type compressor eliminates problems associated with the reciprocating movement of other compressors (e.g., metal fatigue is reduced), and produces about one tenth of the torque. Third, the crescent shaped pockets are paired and offset at 180° thereby reducing non-symmetrical pressures and the vibrations and noise attendant thereto. Finally, because of their efficiency, scroll-type compressors may be smaller and lighter, and require fewer parts, resulting in lower manufacturing costs.

One of the most important concerns in scroll-type compressor efficiency is the tendency of the crescent shaped pockets to leak. Leakage can occur either though the vertical line contacts formed at the orbiting and stationary scroll plate interface at the front or back end of each pocket, or at the horizontal seals formed at the tips of a wrap 14'*a* and 20'*a* and the flat surface of the opposing scroll plate 14'*b* and 20'*b*. Most fluid pressure loss is through the horizontal seals.

Therefore, efforts have focused on minimizing fluid leakage past the tips of the wraps. One way of doing so is to minimize the clearance between scroll tips and the opposing plates. However, increasing the contact pressure on the scroll plate tips will cause premature wearing of the wrap tips and decrease the service life of the scroll plate.

The opposite problem is created by the pressure increase within the interior space which tends to produce an axial force separating the scroll plates. To counteract this separating axial force, air bushings 3 have been used. These air bushings 3 have back-pressure pockets 58' which are interconnected with the interior space through pressure equalizing passages 106'. Therefore, as the pressure in the interior space increases, the counteracting pressure in the back-pressure pocket will increase accordingly, thereby improving the efficiency of the compressor. An example of a conventional scroll-type compressor having this configuration is described in U.S. Pat. No. 4,557,675 to Murayama et al.

Another conventional configuration uses a back-pressure pocket located between the "fixed" scroll plate and a partition between the high pressure outlet region of the compressor and the low pressure inlet region. In this type of configuration, the "fixed" scroll plate is actually permitted to displace axially in response to the axial pressures created by the back-pressure pocket and the pressure within the crescent-shaped pockets.

These conventional configurations possess certain drawbacks that render their manufacture difficult. Moreover, these configurations operate at less than maximum efficiency due to problems encountered during the compressor's assembly or problems that are an unavoidable consequence of the compressor design.

No matter how efficient a compressor design is in theory, its individual parts must be assembled prior to use. The more complex the design, the more likely it is that parts may be damaged or misaligned during assembly. Thus, simplicity of assembly plays an important role in reducing the costs and maintaining system integrity of compressors. Reducing the number of components and eliminating any complex assembly steps are important advances in producing an efficient and reliable scroll-type compressor.

A related problem results from the extremely low tolerances that typically are required for scroll-type compressor components. For example, in conventional configurations that permit axial movement of the fixed scroll, a stop-bolt is generally used to prevent displacement past a certain point. In order to maintain a high operating efficiency, the bolt's dimensions and threads must be very precise. The cost of machining compressor components, such as the stop-bolt, to low tolerances significantly increases the overall cost of manufacture. Moreover, assembling these components requires precise assembly techniques that are highly dependant upon the skill of the assembler. Any error or imprecision during assembly detracts from the overall efficiency of the compressor once it is in use.

In those assemblies that use bolts to rigidly fix the fixed scroll to prevent any movement, including axial displacement, problems such as mechanically or thermally induced stresses can decrease the efficiency of the compressor. These systems also maintain intimate contact between the tips and the opposing plates of the scroll plates at all times. This intimate contact requires the compressor motor to overcome high static friction and inertia during the start-up phase of the compressor operation, thereby further reducing the overall efficiency of the compressor.

Compressor design assembly is also complicated by the lubricating system. Like any mechanical system in which parts slide relative to each other, a scroll-type compressor must provide lubrication to its components or risk premature wearing of parts. Conventional systems, however, use a complex arrangement of oil supply and return passages that render the overall compressor design complex and more difficult to assemble.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention comprises a scroll-type fluid compressor, including a frame having a groove located thereon, a non-orbiting scroll plate having an end plate on which a spiral shaped wrap is located and a slot aligned with the frame groove. An orbiting scroll plate having an end plate on which a spiral shaped wrap is arranged to define an interior space comprising a series of movable, crescent shaped pockets which reduce in volume as they move radially inwardly towards a center point during an orbiting cycle in which the orbiting scroll plate orbits relative to the non-orbiting scroll plate. A block is located in the groove and extends into the slot to prevent undesired radial and rotational displacement of the non-orbiting scroll plate.

It is to be understood that both the foregoing general description and the following detailed description are exemplary and explanatory, and are not restrictive of the invention as claimed.

DETAILED DESCRIPTION OF THE PREFERRED EMBODIMENT

Figure 1:
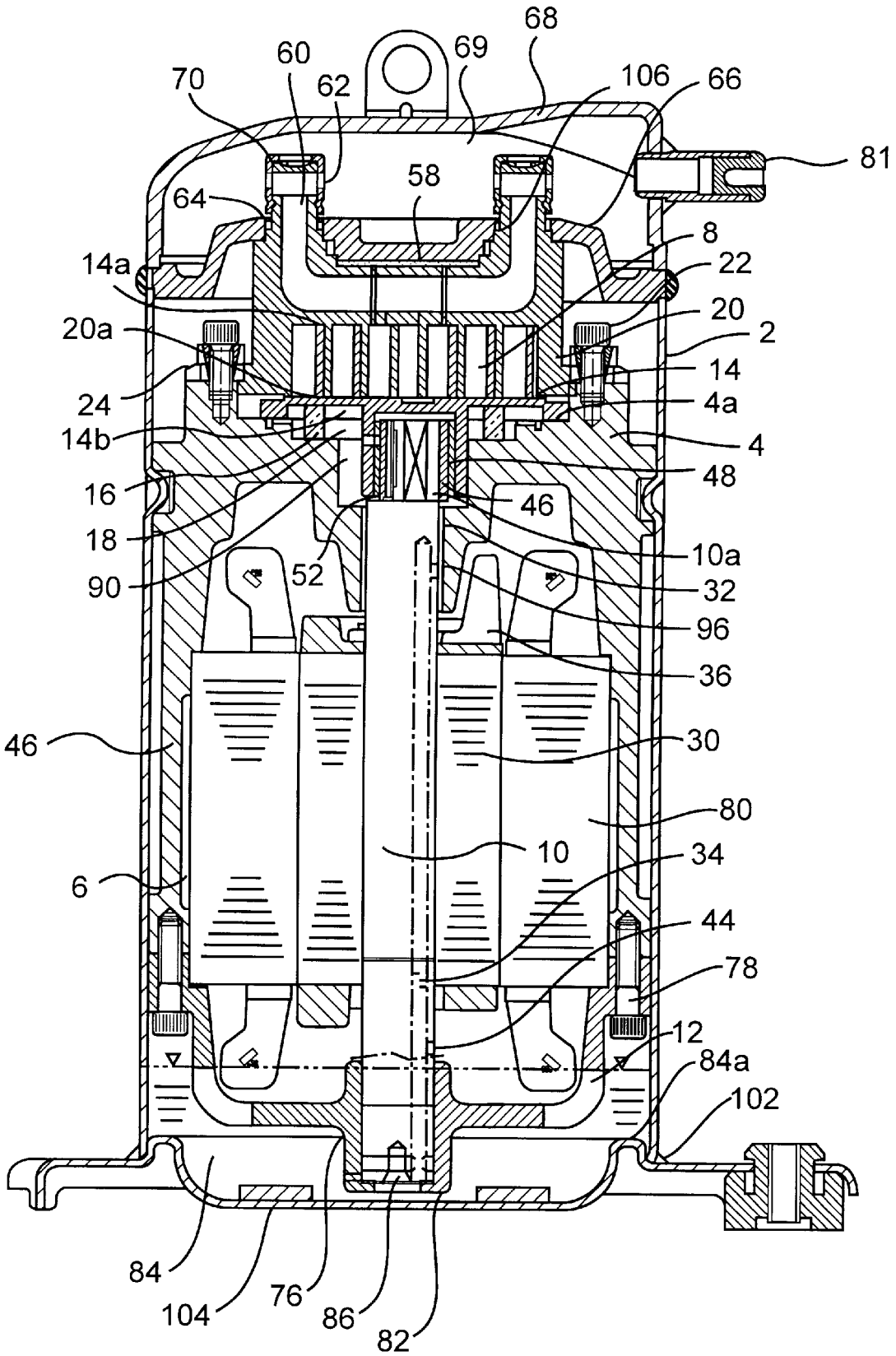
FIG. 1 illustrates a scroll-type compressor according to an embodiment of the present invention.
Figure 2:
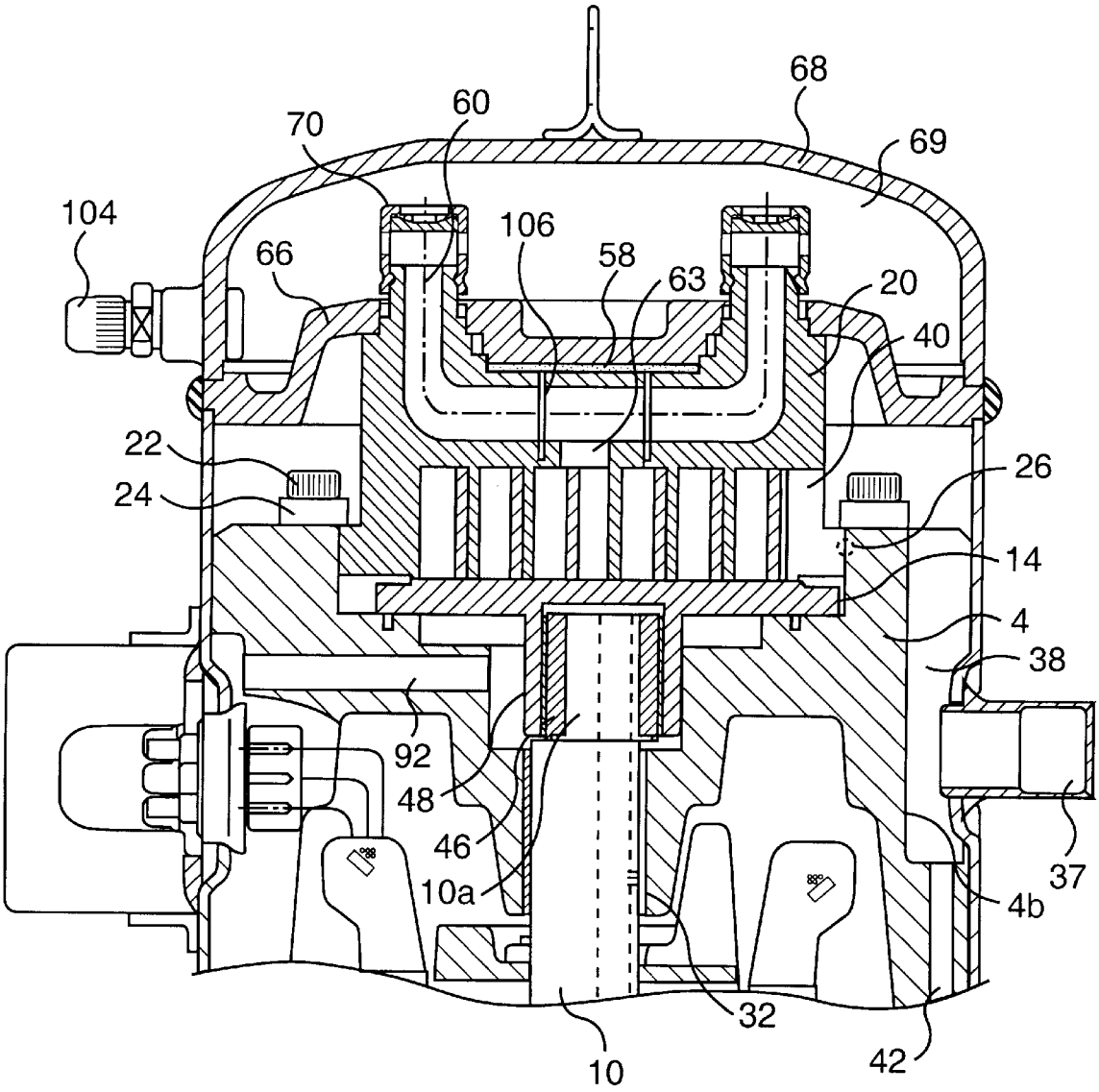
FIG. 2. is a sectional view of the upper portion of the scroll-type fluid compressor in FIG. 1.
Figure 24:
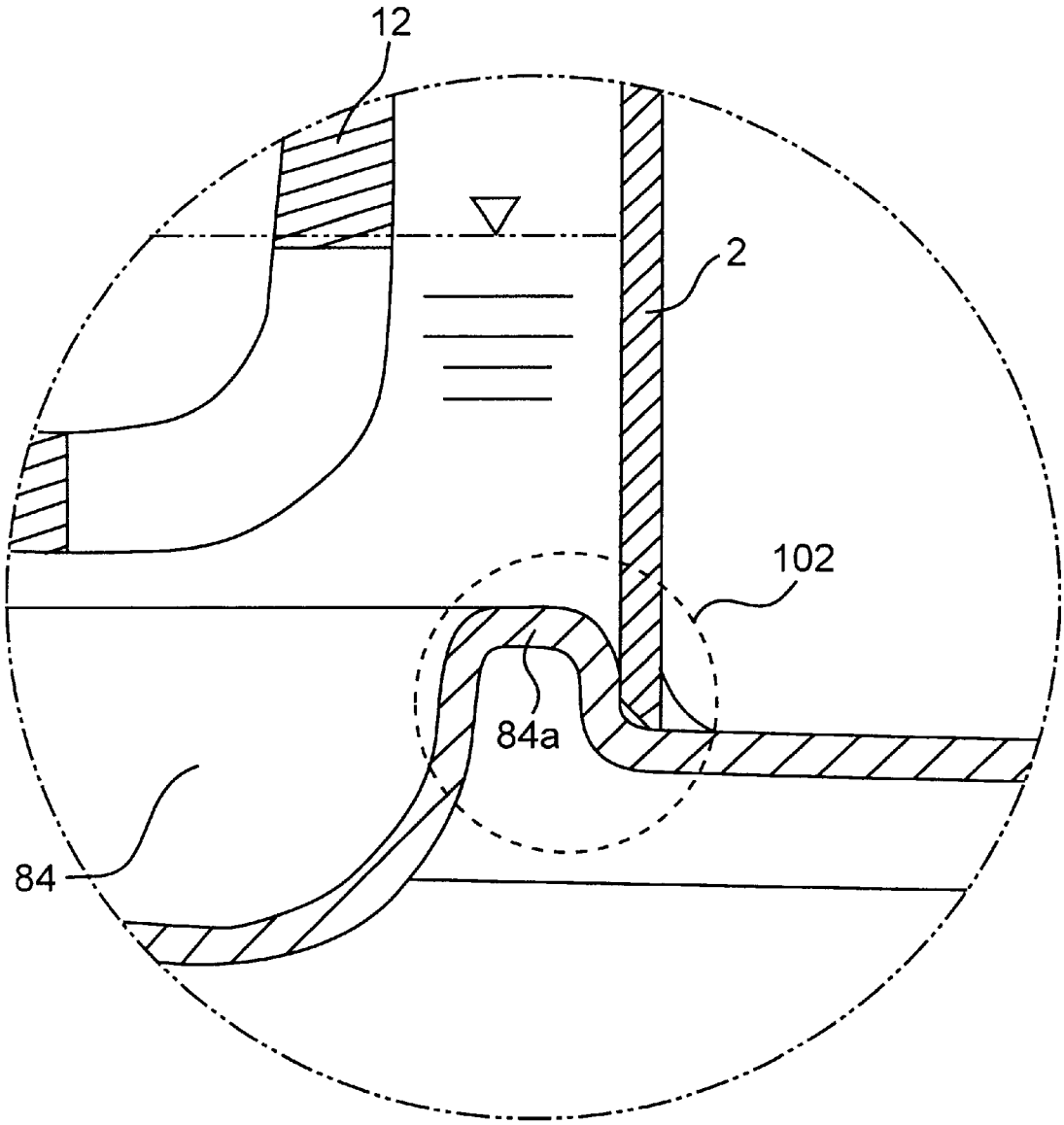
FIG. 24 is a sectional view to show the lower chamber welding.

FIGS. 1 and 2 illustrate a preferred embodiment of the present invention. The scroll compressor includes a hermetically sealed casing composed of an upper chamber 68, an intermediate chamber 2, and a lower chamber 84. These chambers may be welded together to form the casing. As shown in FIG. 24, the inner wall of the intermediate chamber 2 may be fitted about an outer surface of a ridge 84*a* on the lower chamber 84 and welded thereto by a weld bead 102 that is formed at the joint between the outer wall of the intermediate chamber and the lower chamber. The ridge helps prevent the molten welding material from penetrating into the interior of the hermetically sealed casing during assembly of the compressor.

An upper frame 4 may be tight fitted in the intermediate chamber 2. As shown in FIG. 1, the upper frame preferably contacts the intermediate chamber at a plurality of surfaces to better damp the casing to minimize noise and vibration. This upper frame supports an orbiting scroll plate 14 and a non-orbiting scroll plate 20. The non-orbiting scroll plate is made up of an end plate on which a spiral shaped wrap is located so that there is a space 26 which permits the non-orbiting scroll plate 20 some movement as it held in the frame 4.

Figure 22:
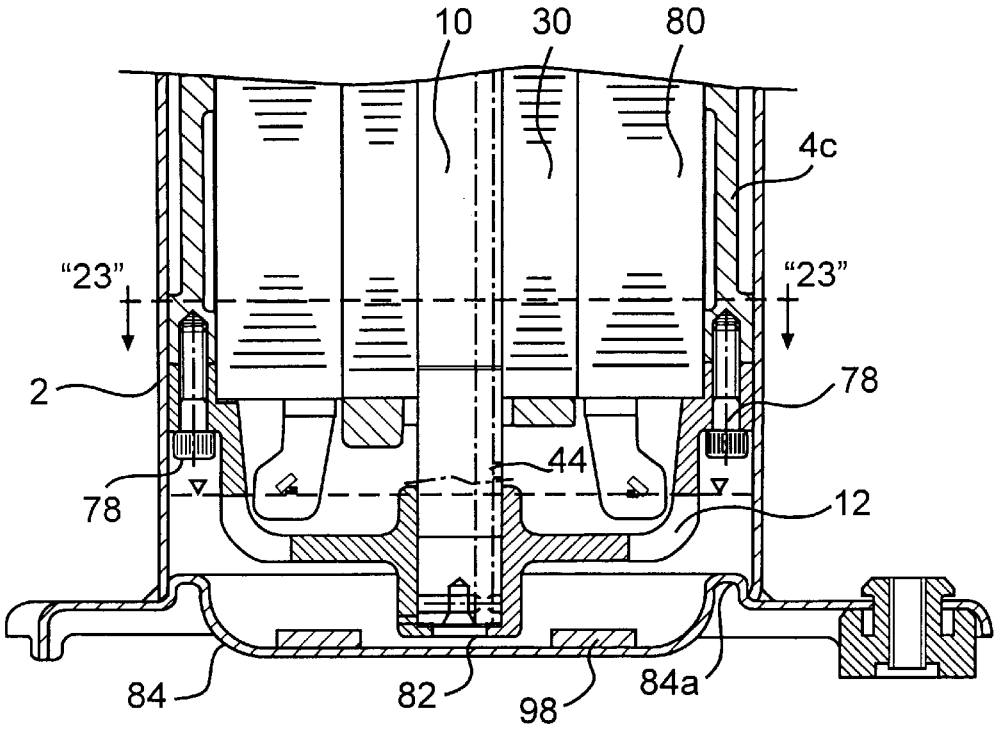
FIG. 22 is a sectional view of the lower part of the machine.
Figure 23:
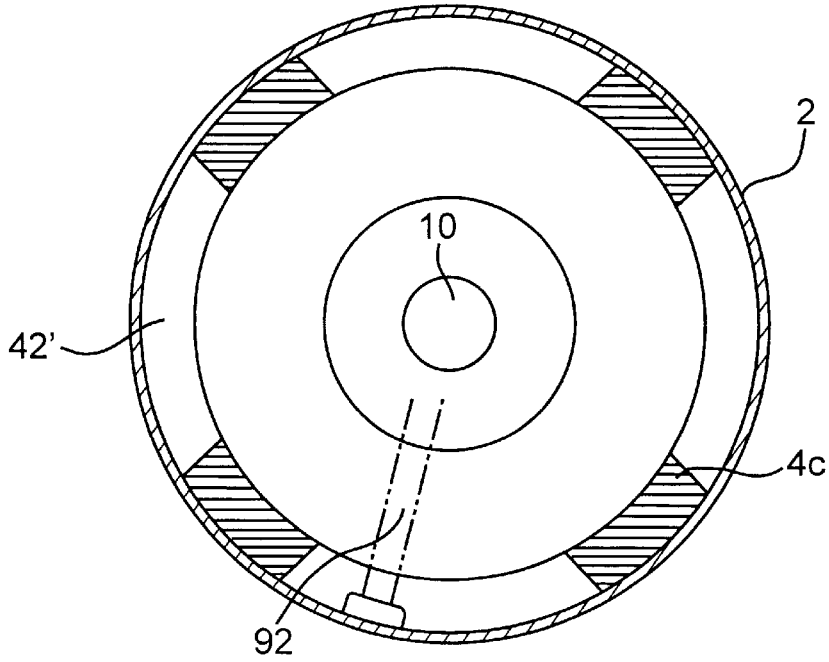
FIG. 23 is a sectional view along the line 23—23 in FIG. 22.

Bolts 78 may fasten the upper frame 4 to the lower frame 12 at the end of thin walls 4*c* of the upper frame as shown in FIGS. 22 and 23. A motor having a stator 80 is shrink fit between the upper frame and a curb 82 of the lower frame, and a rotating shaft 10 is attached to the rotor 30. Because a bolt is used to attach the upper and lower frames, the frames are easily aligned and attached, and thermal distortion from welding can be eliminated. The diameter of the bearing 76 on the lower frame 12 is also increased to provide better stability and strength. A pumping nozzle plate 82 is minimized and located under the shaft to simplify the design.

After the compressor has been assembled, the interior of the upper chamber 69 can be evacuated and the working fluid, for example, a refrigerant, may be introduced through valve 104.

The orbiting scroll plate 14 also has an end plate on which a spiral shaped wrap is located. The orbiting and non-orbiting scroll plates are arranged to interfit their respective spiral shaped wraps to define an interior space 8 in which a series of movable, crescent shaped pockets reduce in volume as they move radially inwardly towards a center point during an orbiting cycle in which the orbiting scroll plate rotates relative to the non-orbiting scroll plate.

Figure 7:
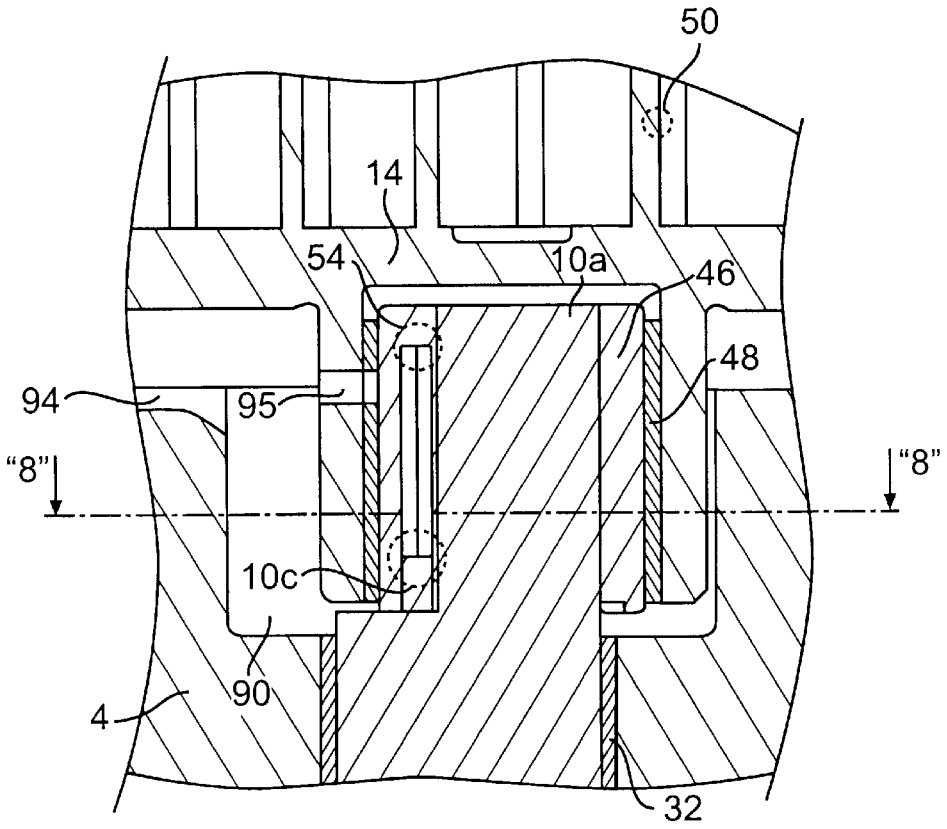
FIG. 7 is a vertical sectional view of the coupling of an orbiting scroll and the shaft tip of an embodiment of the invention.
Figure 8:
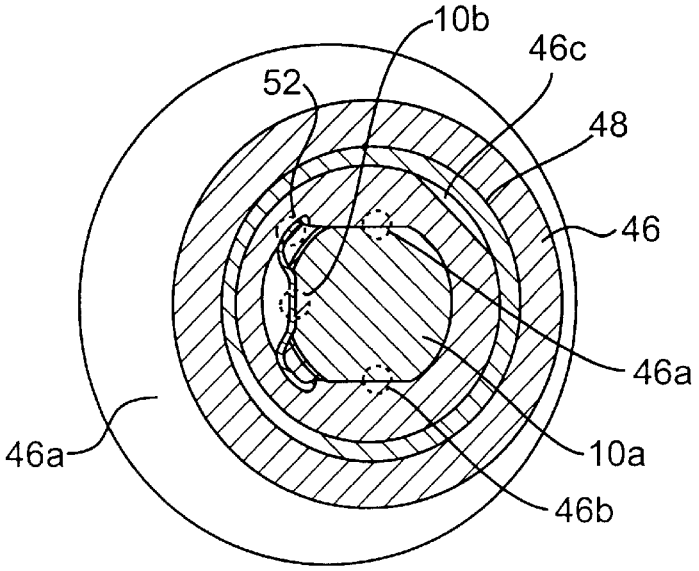
FIG. 8 is a horizontal sectional view along the line 8—8 in FIG. 7.

The orbiting scroll plate orbits relative to the non-orbiting scroll plate by the interaction of a reduced coupling 16 with the rotating shaft 10. As shown in FIG. 7, the shaft 10 terminates in a central hub of the orbiting scroll plate where the shaft includes an eccentric shaft portion 10*a*. A weight balance 36 is included on the rotor to compensate for the unbalance created by the eccentric shaft and the oil passage.

A bearing 48 is interposed between the interior of the central hub and a radial coupling 46 surrounding the shaft 10. The radial coupling includes a sliding interface 46*a*&*b* along which the radial coupling 46 can slide relative to the shaft 10. A spring 52 is fitted between one interior wall of the bearing and the shaft to bias the interior wall away from the shaft. Preferably, the shaft has a notch 10*b* in which the spring 52 may be fitted to prevent its being dislodged during operation. This arrangement permits the orbiting scroll to adjust in response to any unexpected forces, e.g., forces caused by debris being caught between the scroll wraps, or unbalanced inertia and tilting moments. One side of the coupling is flattened 46*c* so that lubricating oil can better penetrate into the interface between the coupling 46 and the bearing 48.

Figure 9:
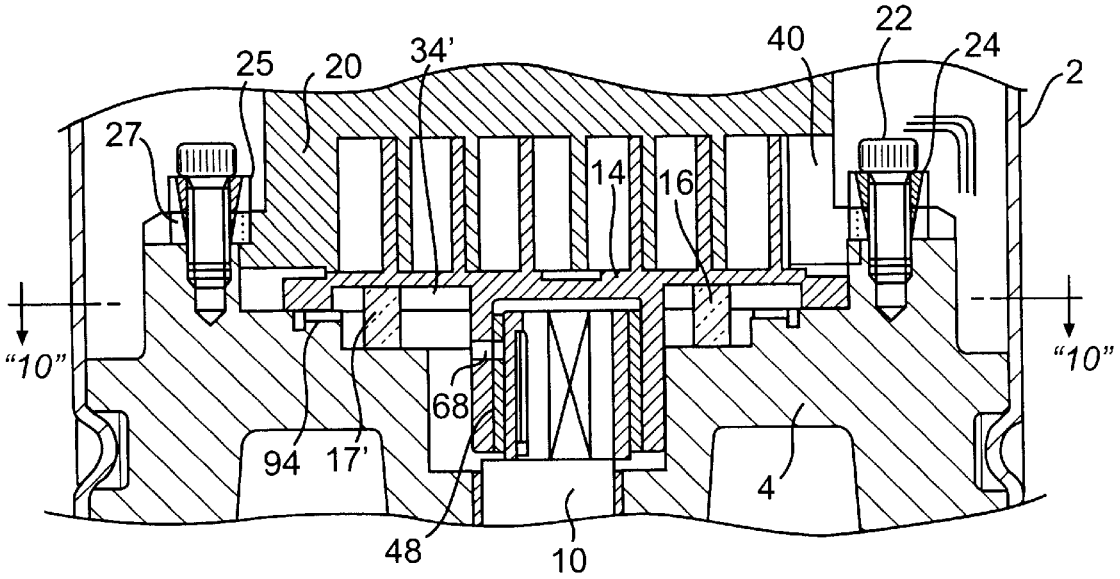
FIG. 9 shows the arrangement of the fixed and orbiting scroll and surrounding components.
Figure 10:
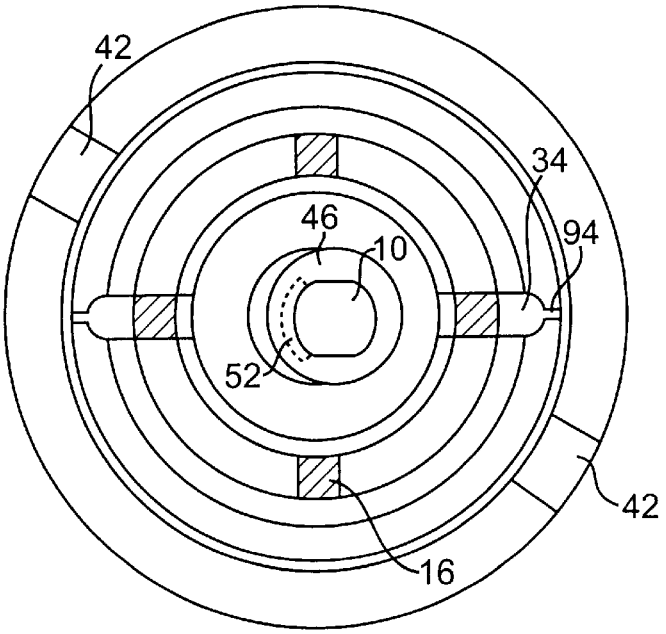
FIG. 10 is a horizontal sectional view along the line 10—10 in FIG. 9.
Figure 11:
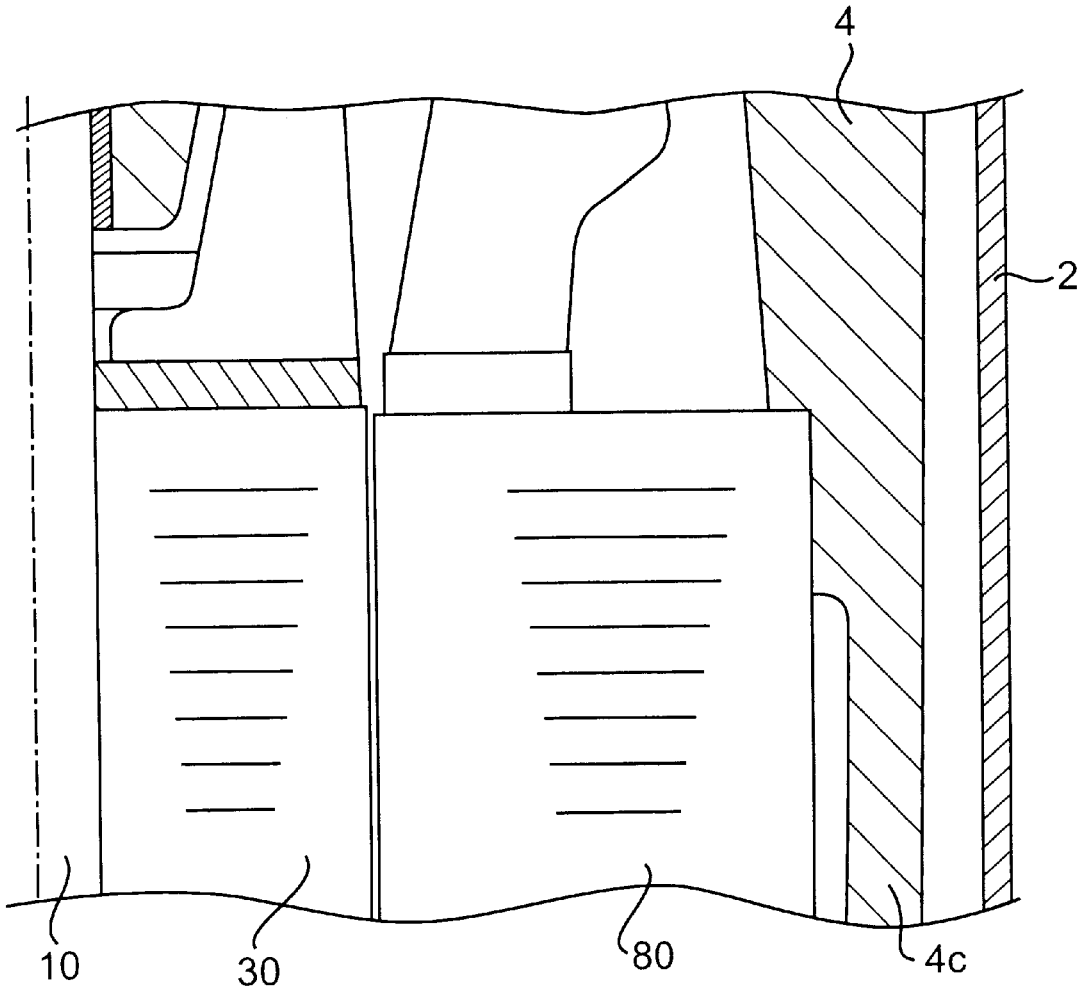
FIG. 11 shows the stator assembly of a motor.
Figure 12:
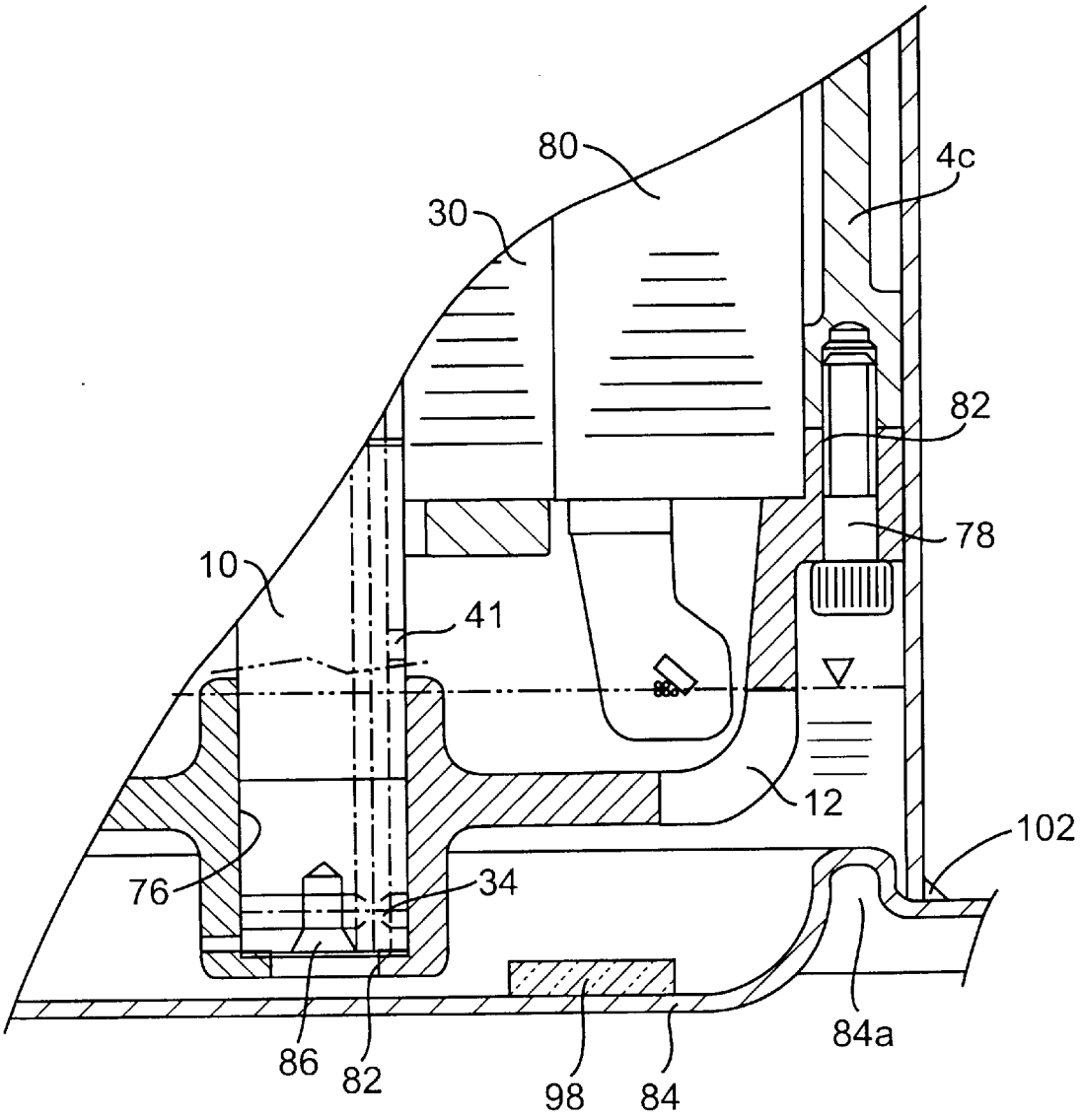
FIG. 12 shows the stator and shaft assembly.
Figure 13:
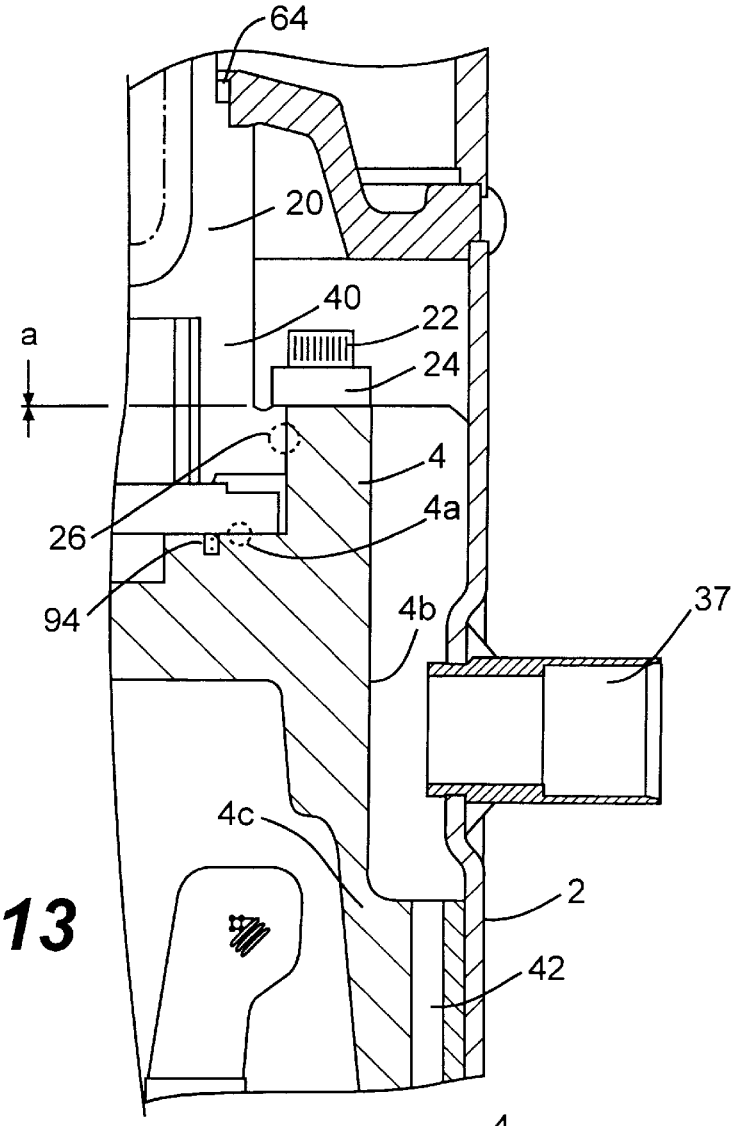
FIG. 13 displays the oil-separation portion of the frame.
Figure 14:
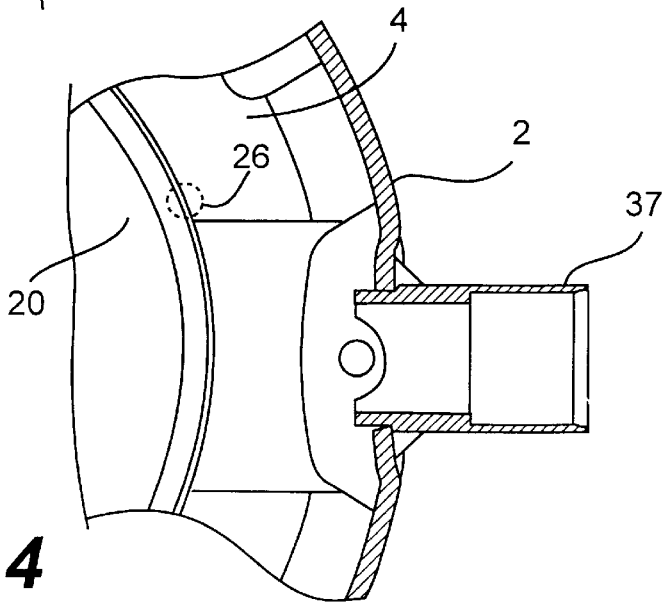
FIG. 14 is a horizontal sectional view of the suction port shown FIG. 13.
Figure 15:
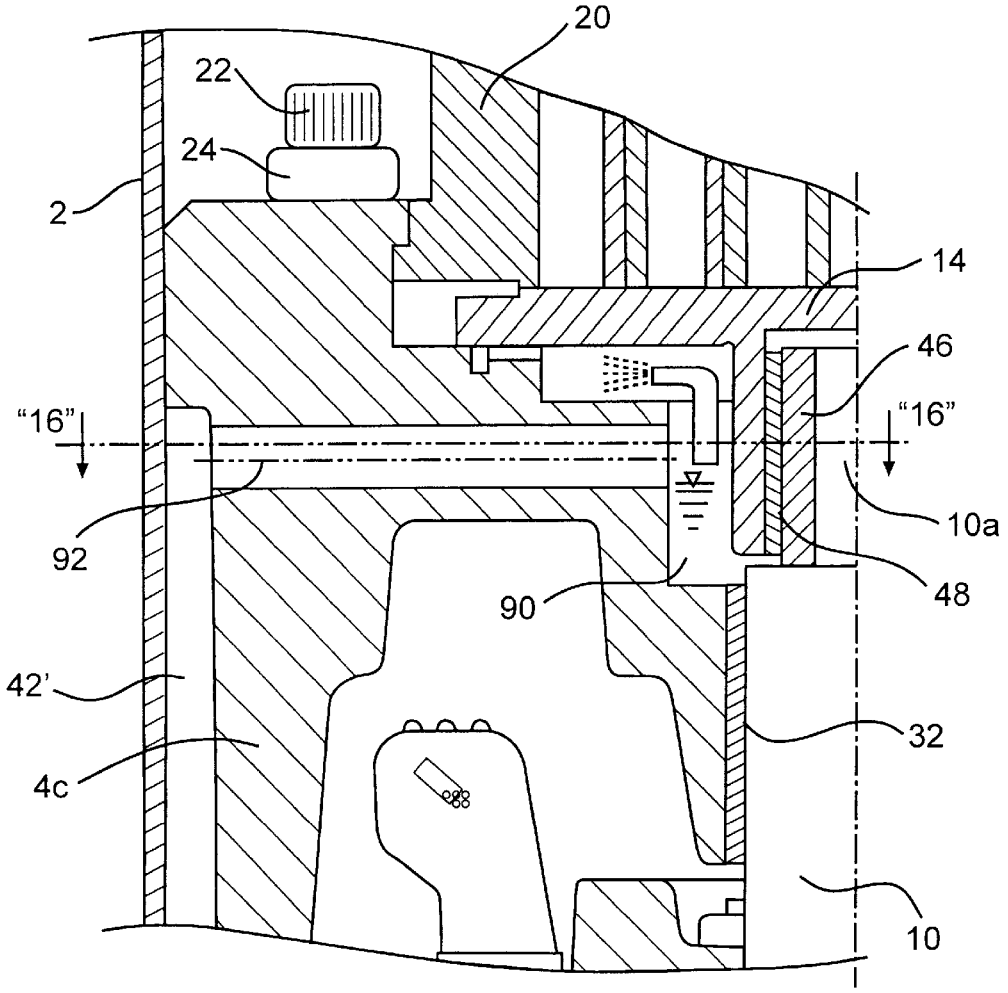
FIG. 15 is a vertical sectional view of a horizontal lubrication return hole in the frame.
Figure 16:
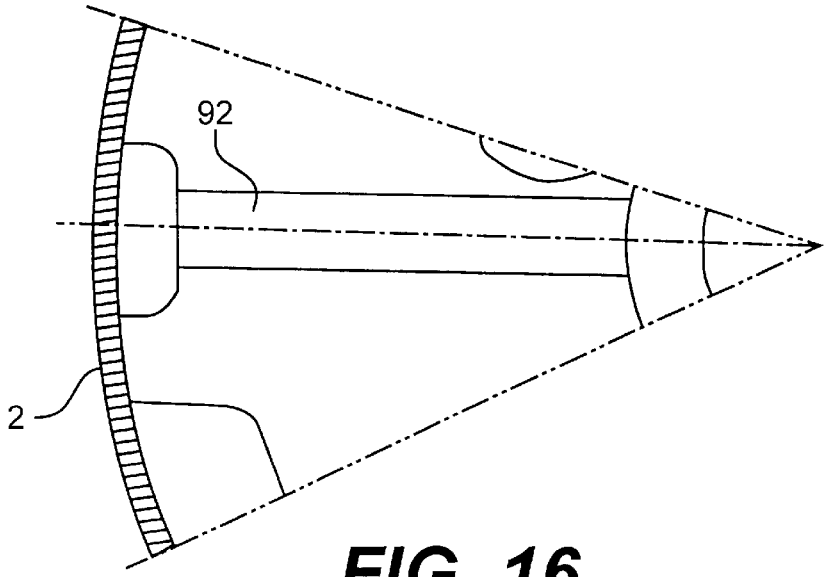
FIG. 16 is a horizontal sectional view along the line of 16—16 in FIG. 15.

An orbital coupling is depicted in FIG. 10. A slide groove 34 is formed on a sliding surface 4*a* (in FIG. 13) of the frame 4. A corresponding sliding surface is located on the orbiting scroll plate which slides on the frame slides in an orbiting movement. A similar slide groove 34' is located on the corresponding sliding surface of the orbiting scroll and is offset from the slide groove on the frame by 90 degrees. A reduced coupling 16 interposed between the frame and the orbiting scroll has cleats 17 and 17' inserted into each of the sliding grooves 34 and 34', respectively. The reduced orbital coupling 16 is smaller than conventional Oldham's couplings and is dimensioned so that the inner diameter is just large enough to clear the hub of the orbiting scroll plate as it orbits. The cleats 17 and 17' are therefore closer to the center hole of the frame 4 to minimize the size of the coupling, and the sliding groove 34 extends directly off the center hole in the frame, and the slide groove 34' extends substantially directly off the hub of the orbiting scroll plate 14. The orbital coupling 16 translates the rotating movement of the eccentric shaft 10*a* into an orbiting movement as the cleats 17 and 17' translate along the sliding grooves 34 and 34' of the frame 4 and the orbiting scroll 14. This improved orbital coupling does not require the end plate of the orbiting scroll plate to extend as far beyond the scroll wraps as compared to conventional Oldham's couplings (compare the end plate of FIG. 9 to the conventional end plate shown in FIG. 32). The smaller end plate reduces the moment of inertia of the orbiting scroll plate making the compressor more efficient.

A pressure partition 66 is located adjacent to the non-orbiting scroll plate 20 in a position opposite to the upper frame 4. This pressure partition separates a region of high discharge pressure 69 from a region of low suction pressure 38. As the scroll plates orbit relative to each other, the working fluid of the compressor enters the interior space 8 from the region of low suction pressure and progresses through the interior space in crescent shaped pockets that reduce in volume until they discharge the high-pressure fluid at the central region 63 of the non-orbiting scroll plate and through discharge ports 60. The fluid then flows to the region of high discharge pressure 69 through check valve 70 and exits the compressor through discharge pipe 81.

Figure 17:
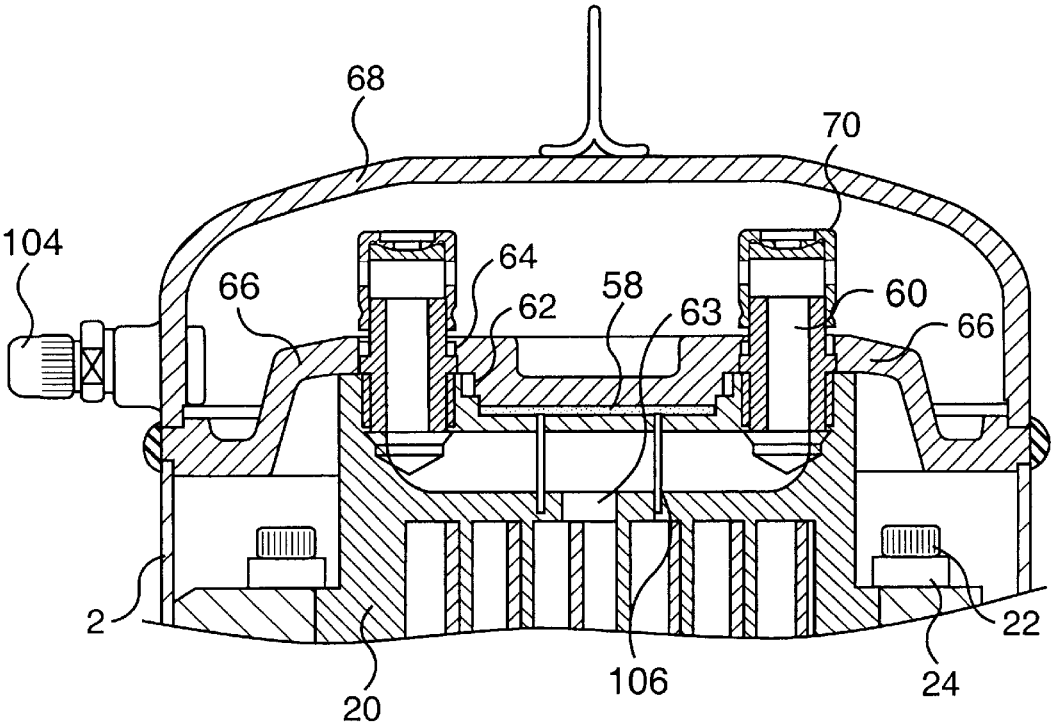
FIG. 17 is a vertical sectional view of discharge ports.
Figure 18:
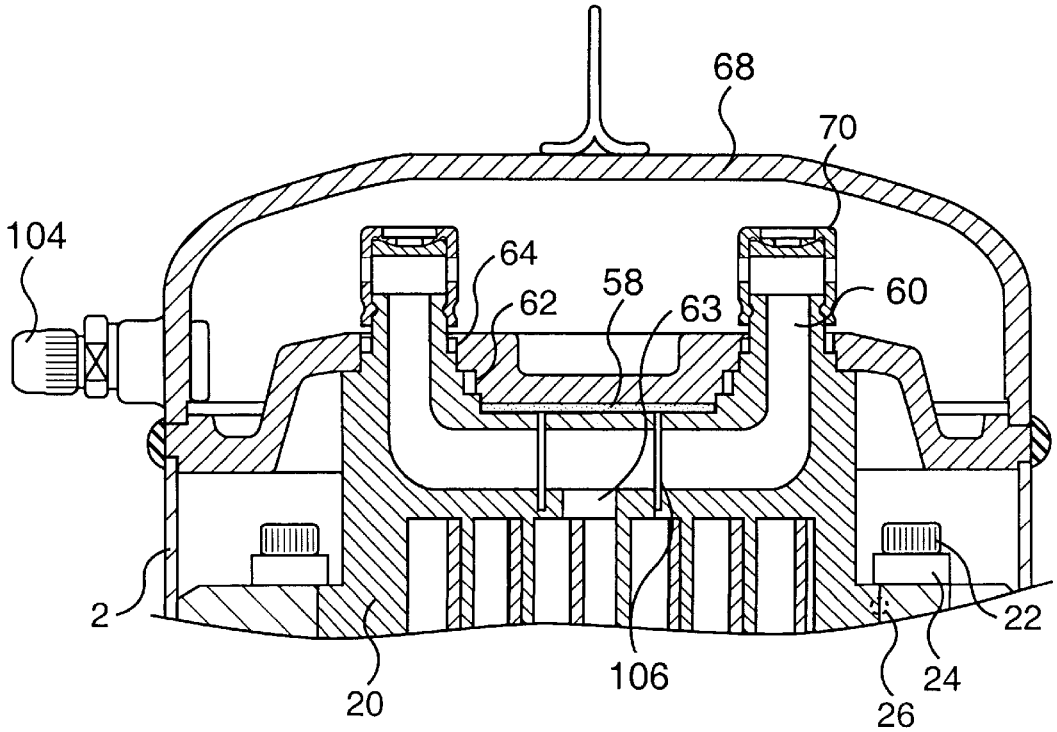
FIG. 18 shows discharge ports manufactured by a different process than those shown in FIG. 17.
Figure 19:
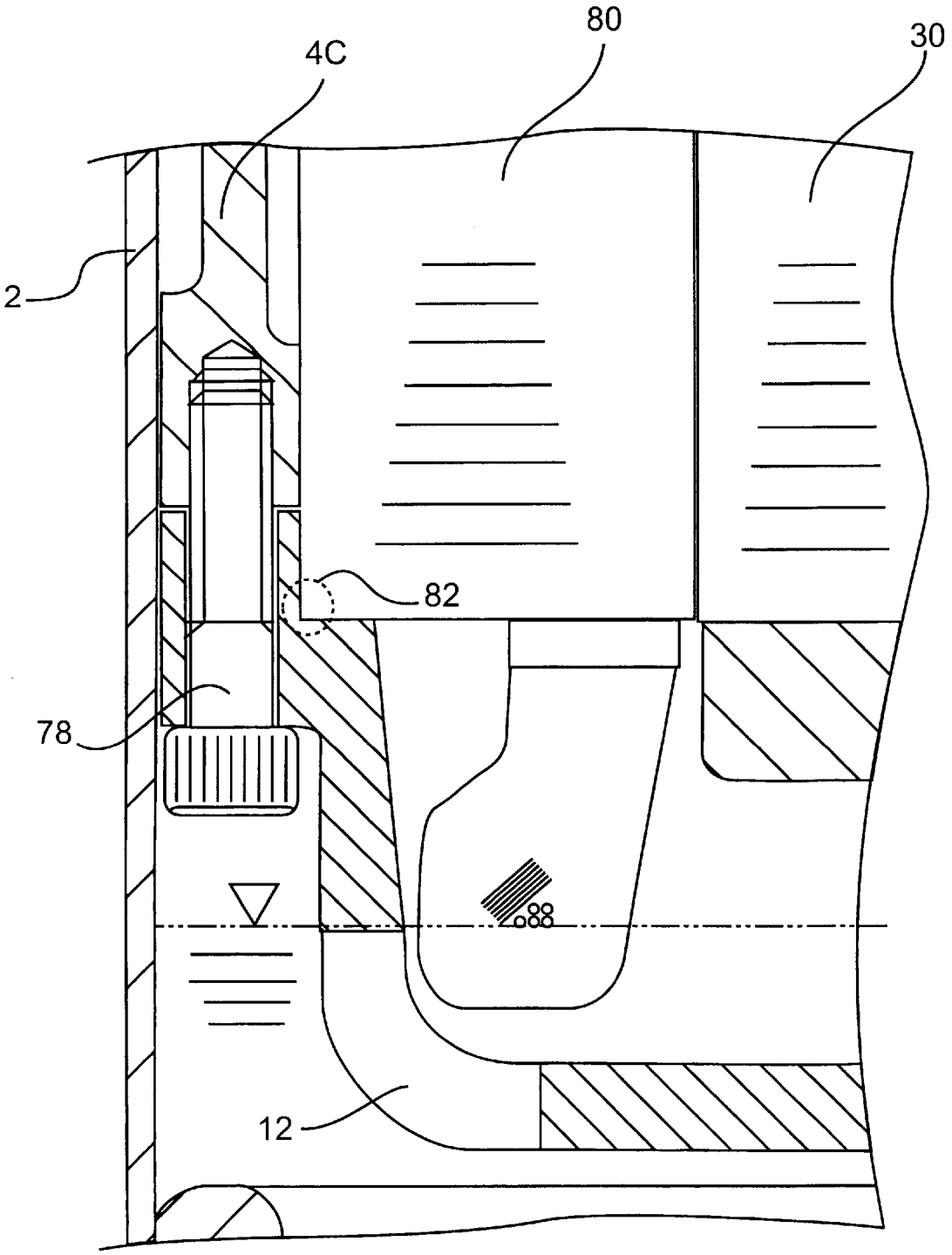
FIG. 19 shows the assembly portion of the stator, upper and lower frames.

The plurality of discharge ports of this embodiment impart several advantages. For example, the speed of the discharge fluid can be reduced by using a plurality of discharge ports with a consequent decrease in noise. Moreover, the plurality of discharge ports spread the heat of the discharge fluid about a greater volume of the scroll plate, thereby ensuring a more uniform distribution of heat and reducing the thermal distortion of the scroll plate. The scroll plate's thickness can also be increased thereby imparting improved resistance to distorting forces. The discharge ports can be formed as integral components in the non-orbiting scroll plate, as demonstrated in FIG. 18, or they may be inserts, as shown in FIG. 17, placed into holes drilled into the scroll plate after it has been formed, e.g., by casting. In FIG. 2 two discharge ports 60 have radially extending discharge passages that radiate outwardly from a central portion of the non-orbiting scroll plate and then bend to discharge high pressure fluid in an axial direction into the high pressure discharge region 69. Preferably, two discharge ports are arranged at equal spacings from each other.

Figure 5:
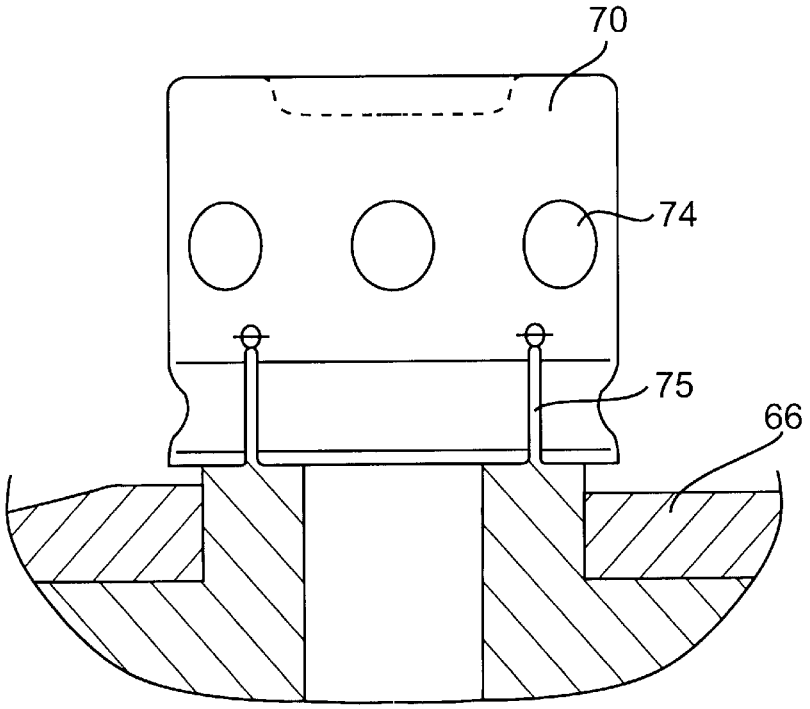
FIG. 5 shows a check valve in a device according to the invention allowing outflow of high-pressure fluid.
Figure 6:
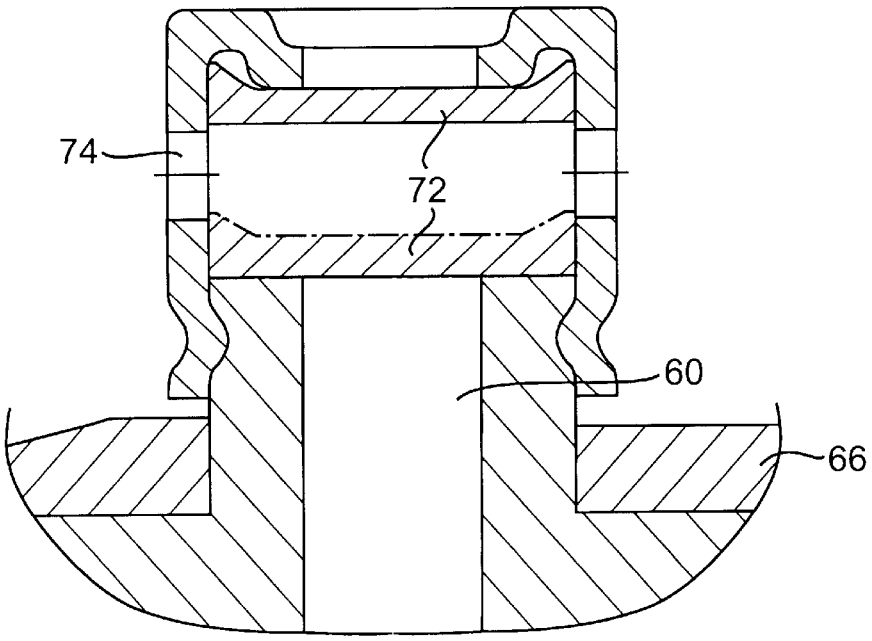
FIG. 6 is a sectional view of the check valve of FIG. 5.

Referring to FIGS. 5 and 6, check valves 70 are located at the discharge ports 60 to prevent back-flow. Conventional configurations that employ a check-valve at the discharge pipe 81 rather than the discharge ports 60 are prone to damage. For example, when the compressor is turned off, pressure may build up in the high discharge pressure region 69 causing fluid to flow back through the discharge port and into the interior space 8. This back-flow may cause reverse rotation of the scroll plates. Because the plates are designed to rotate only in one direction, reverse rotation may cause severe wrap damage. Even if the wraps are not damaged by the reverse rotation, at the very least, reverse rotation is accompanied by an annoying noise, or may cause an undesirable reverse current through the motor 80.

The check valve 70 comprises a plate 72 and multiple discharge holes 74 located at various positions in the housing. During the operation of the compressor, high pressure fluid exits the discharge ports 60. The fluid pressure lifts the plate 72 off of the discharge port 60 and allows fluid to escape through the holes 74. The housing prevents plate 72 from moving too far away from the discharge port.

The plate 72 seats itself back onto the discharge port when the high-pressure discharge is discontinued, e.g., when the compressor is shut off. This seating action can result from gravity and/or by the back-flow pressure of the fluid in the high pressure discharge region 69. The plate thus prevents back-flow into the interior space 8.

A pressure equalizing passage 106 is formed in the non-orbiting scroll plate 20 to interconnect a back pressure pocket 58 and the interior space 8. The back pressure pocket 58 is located between the non-orbiting scroll plate 20 and the pressure partition 66 so that the non-orbiting scroll plate can be axially displaced towards and away from the upper frame 4 and the orbiting scroll plate 14. The preferred back pressure pocket uses intermediate pressure to generate a more rapid reaction force. The reaction force response time may be increased because the gaseous intermediate pressure fluid is more responsive than high pressure liquid. Intermediate pressure also properly seals the wrap tips 14*a* without creating the high friction forces that may be associated with high pressure back pressure pockets. A particular pressure equalizing passage configuration using multiple pressure equalizing passages is disclosed in pending U.S. patent application Ser. No. 08/751,018 of Wan Pyo Park et al., filed Nov. 15, 1996, attorney ref, No. 6330.0006, entitled "Scroll-Type Compressor Having Improved Pressure Equalizing Passage Configuration" expressly incorporated herein by reference in its entirety.

A seal 62 is located at the interface between the back pressure pocket 58 and the pressure partition 66 so as to seal off the back pressure pocket from the region of high discharge pressure. Similar seals 64 are located between the region of low suction pressure and the discharge ports 60 to prevent the higher pressure fluid around the discharge ports 60 from entering into the region of low suction pressure. As the non-orbiting scroll plate moves towards the pressure partition, these seals are compressed in the axial direction. The seals are configured so that they maintain the integrity of the seals between the regions of different pressure even when the non-orbiting scroll is at its maximum displacement away from the pressure partition.

These seals are much more easily installed than conventional seals. The seals can simply be axially inserted into grooves in the non-orbiting scroll or in the pressure partition—a significantly simpler arrangement than the radial installation required for conventional radial seals. As will be explained below, the entire compressor can be progressively assembled with each major component axially positioned into its appropriate location.

Another embodiment of the invention is shown in FIGS. 31 and 33–36 which includes radially extending discharge passages that terminate at discharge ports 60" for radially discharging high pressure fluid into holes 162 formed through the pressure partition 66" and which open out into the region of high discharge pressure 69". The radial discharge ports reduce the discharge resistance of the high pressure fluid, thereby increasing the efficiency of the compressor and further reducing the noise and vibration associated with the high pressure discharge. In this embodiment, the back pressure pocket 58" is preferably located between the discharge ports 60" and the pressure partition 66" over the central region 63'. Like the other multiple discharge embodiment, this arrangement allows the size of the back pressure pocket 58" to be maximized because the size is no longer constrained by a conventional central discharge port which would interrupt the back pressure passage requiring it to be ring-shaped. The increased area of the back pressure pocket provides a greater surface area of force to prevent the orbiting scroll plate from wobbling during operation and enables more stable axial displacement.

Figure 33:
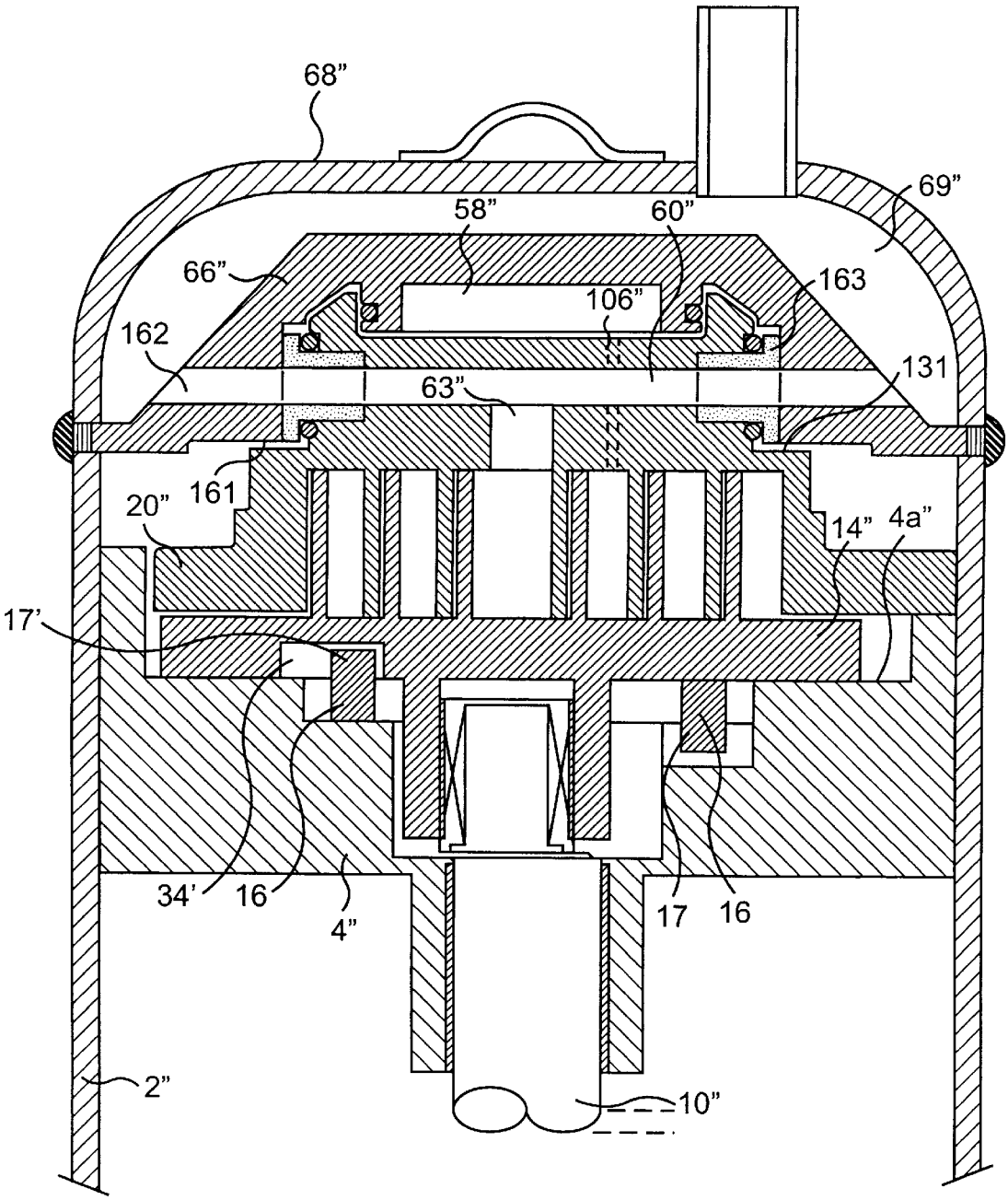
FIG. 33 illustrates a scroll-type compressor equipped with bushings.

As shown in FIG. 33, bushings 163 may be inserted between the discharge ports 60" and the holes 162 in the pressure partition 66". These bushings provide a simple, replaceable arrangement for preventing wear of the non-orbiting scroll 20" and the pressure partition 66" and improve the seal to ensure that the high pressure discharge fluid is properly introduced into the region of high discharge pressure 69". The bushings 163 are also improve the ease of assembly of the compressor.

Figure 34:
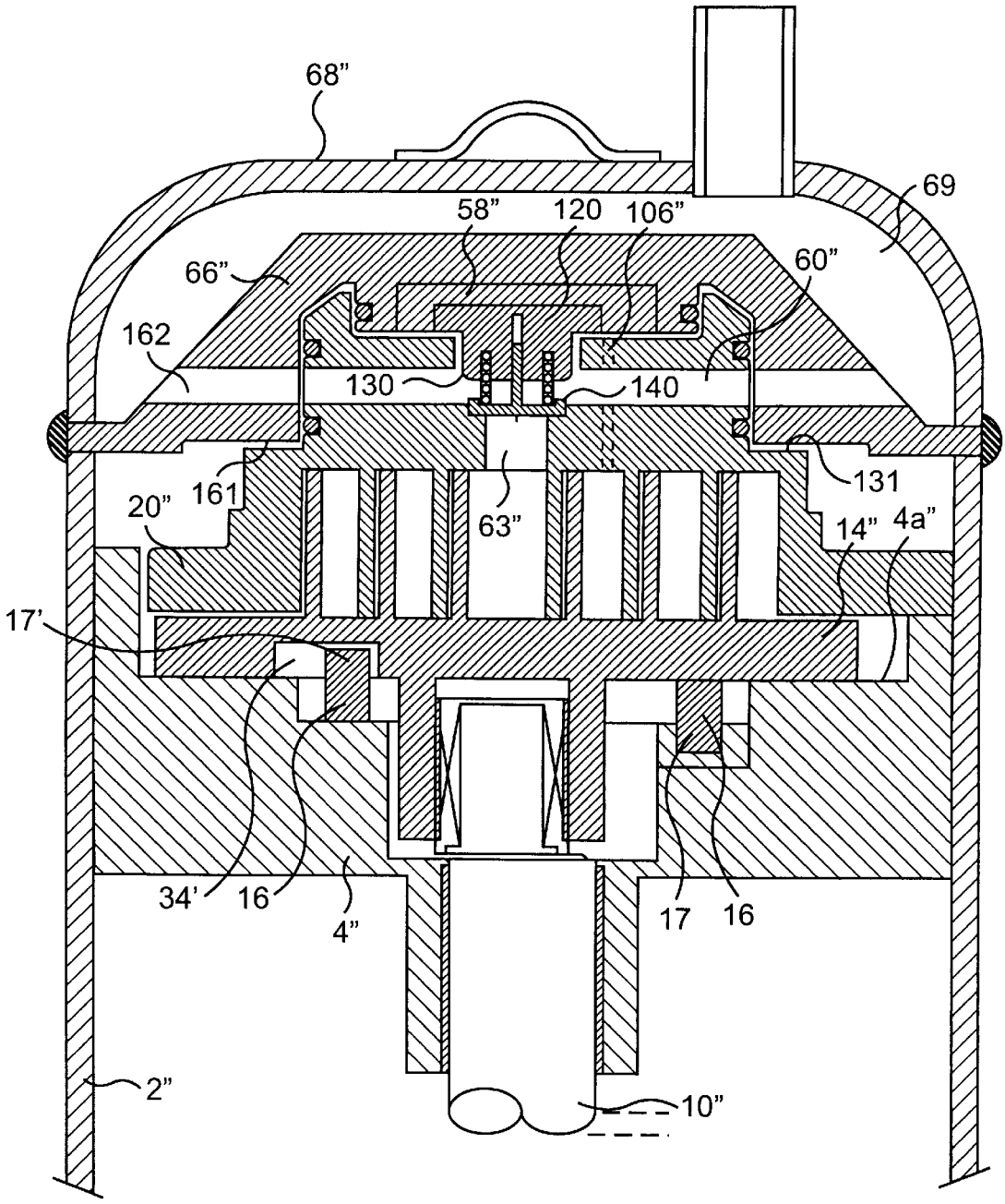
FIG. 34 is a sectional view of an embodiment of the invention using a central check valve.

In FIG. 34, a valve guide bushing 120 is inserted between the central region 63" of the non-orbiting scroll plate 20" and the back pressure pocket 58". A check valve is provided to prevent back flow through the scrolls. The check valve includes a plate 140 that extends from the valve guide bushing 120 to cover the central region 63" of the scroll plate 20" to prevent back flow. Stem 141 extends into the valve guide bushing to ensure stable axial movement in the valve guide 140*a*. Springs 130 may be included to bias the plate 140 towards the central region 63" of the scroll plate 20" to seal off the interior of the scroll plates from the discharge ports 60".

Figure 35:
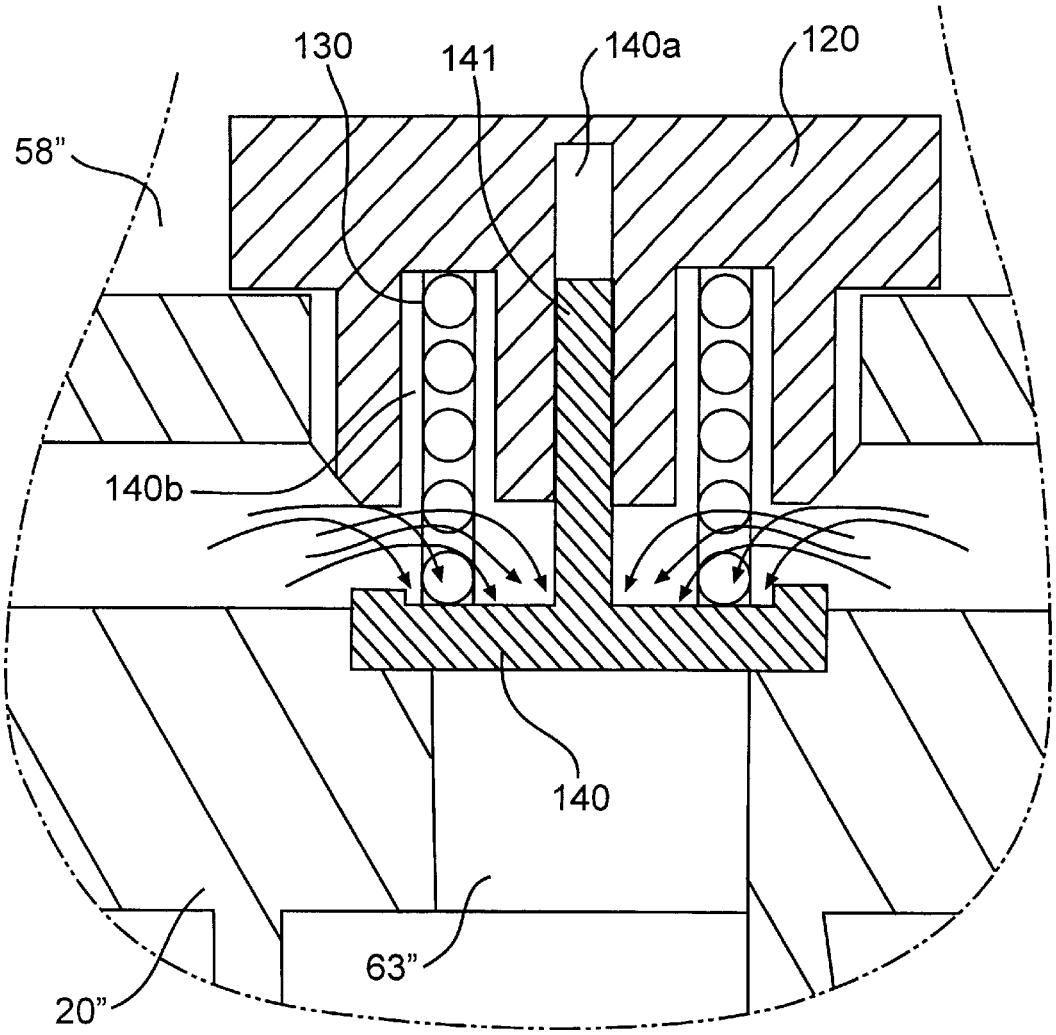
FIG. 35 demonstrates how the central check valve prevents back flow into the scrolls.

As demonstrated in FIG. 35, the plate 140 seats itself onto the discharge port when the high-pressure discharge is discontinued, e.g., when the compressor is shut off. This seating action can result from gravity and/or by the back-flow pressure of the fluid in the high pressure discharge region 69" and/or by the use of springs 130. The plate 140 thus prevents back-flow into the scrolls.

Figure 36:
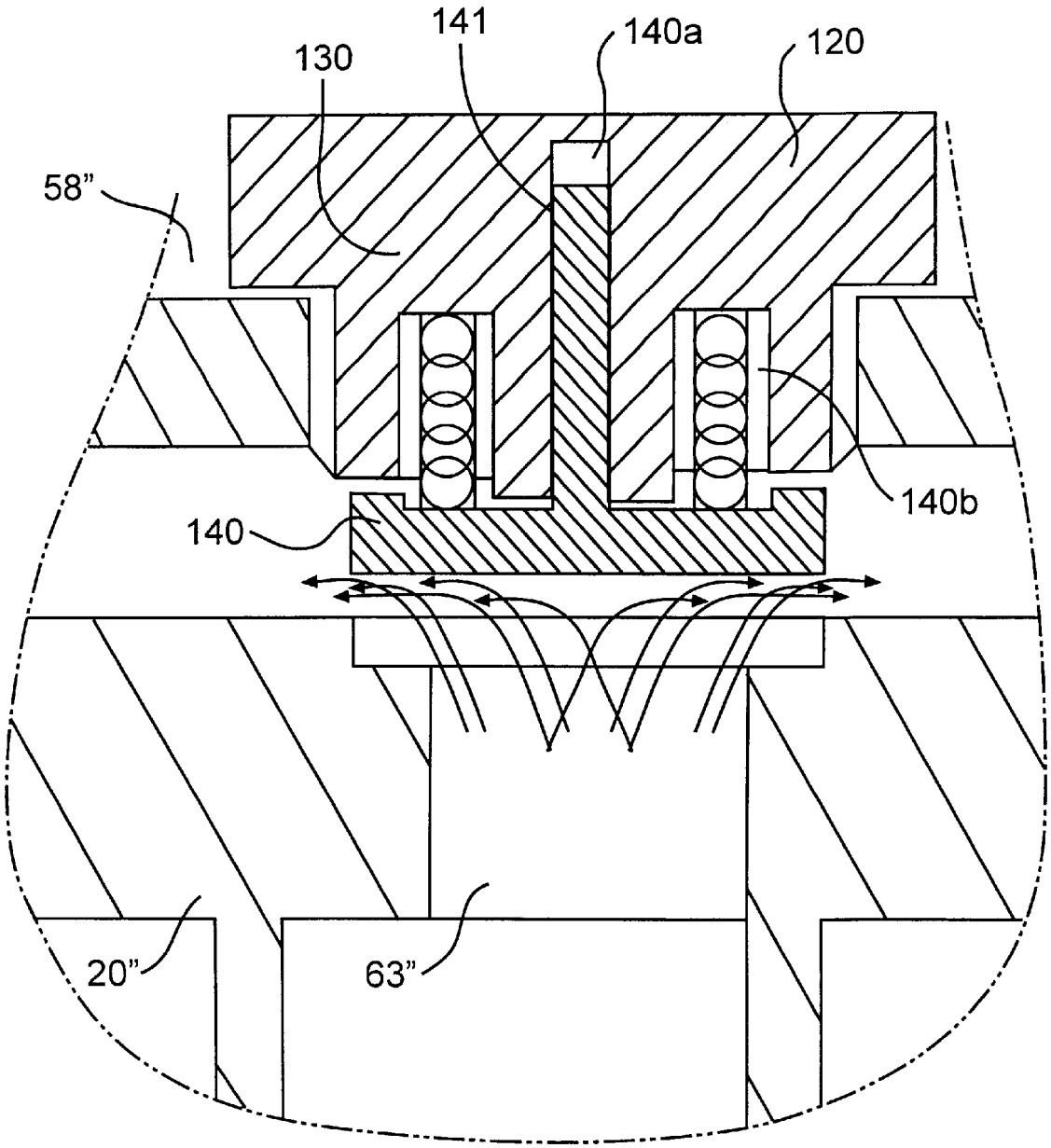
FIG. 36 demonstrates how the central check valve allows flow out of the scrolls.
Figure 37:
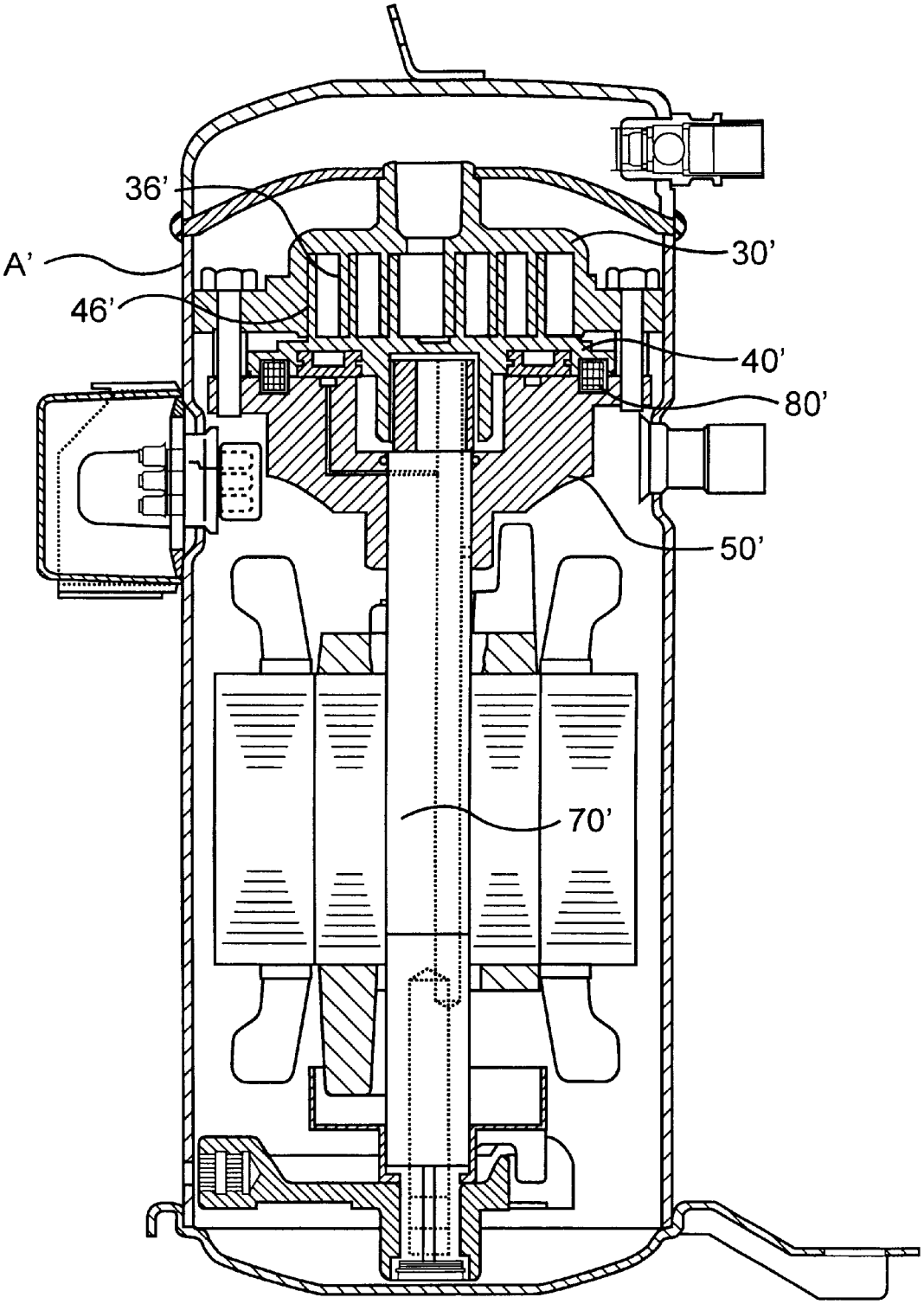
FIG. 37 is a sectional view of a conventional scroll-type fluid compressor.
Figure 38:
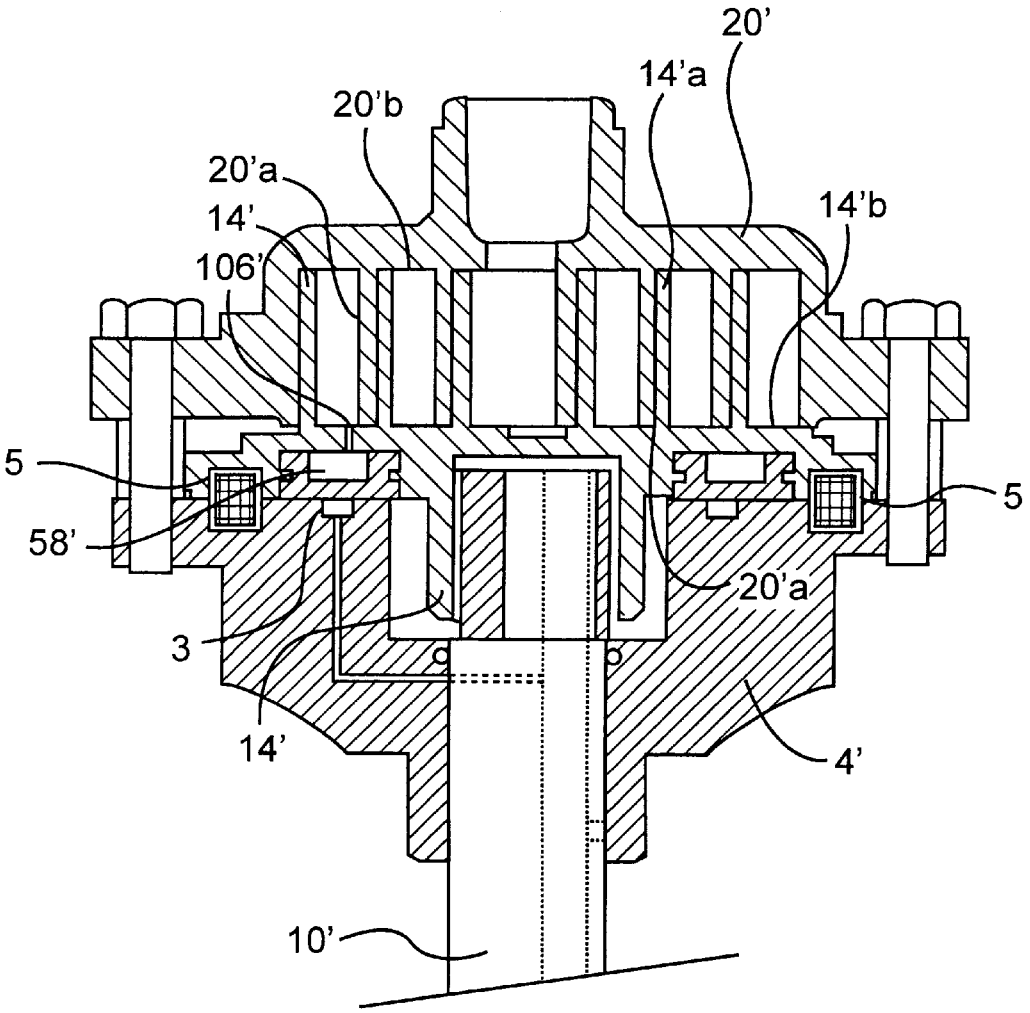
FIG. 38 PRIOR ART
FIG. 38 is a sectional view of a portion of a conventional scroll-type fluid compressor showing two intermitting scroll plates.

FIG. 36 illustrates the check valve during the operation of the compressor as high pressure fluid exits the central region 63" of the scroll plate. The fluid pressure overcomes the force of the springs 130 and lifts the plate 140 off of the central region 63" and allows fluid to escape.

Figure 3:
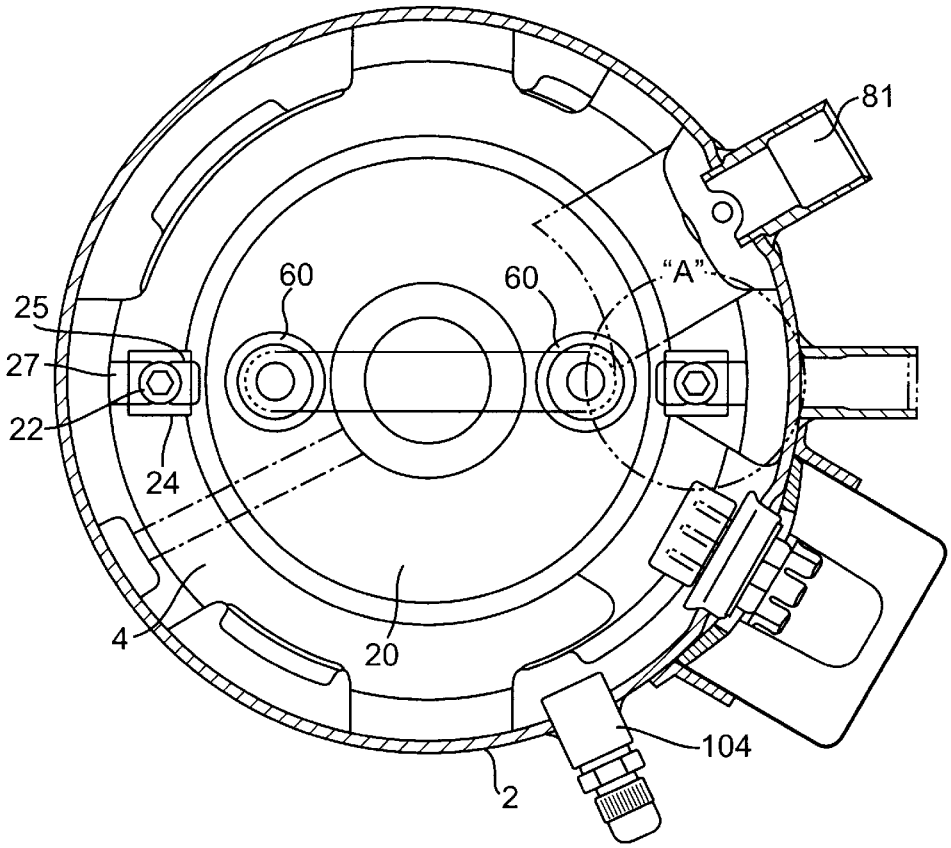
FIG. 3 is a top view of a non-orbiting scroll plate assembled in the upper frame.
Figure 4A:
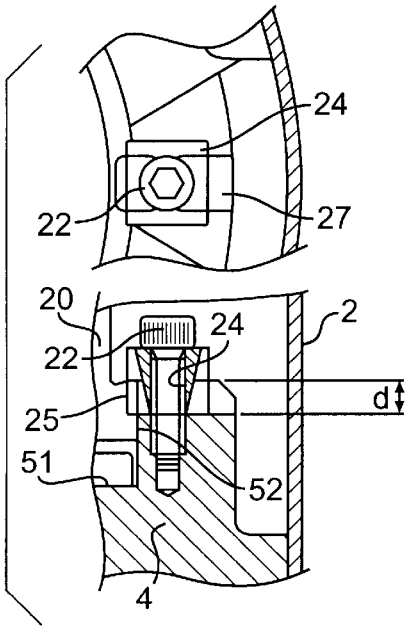
FIG. 4(A) is an enlarged sectional view taken along the circle A in FIG. 3.
Figure 4B:
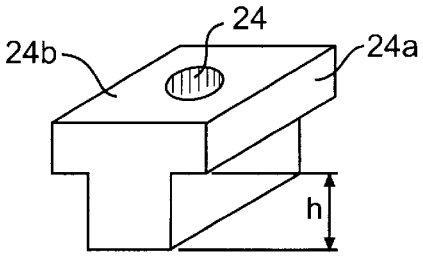
FIG. 4(B) shows an anti-rotating block for fixing the non-orbiting scroll plate.
Figure 20:
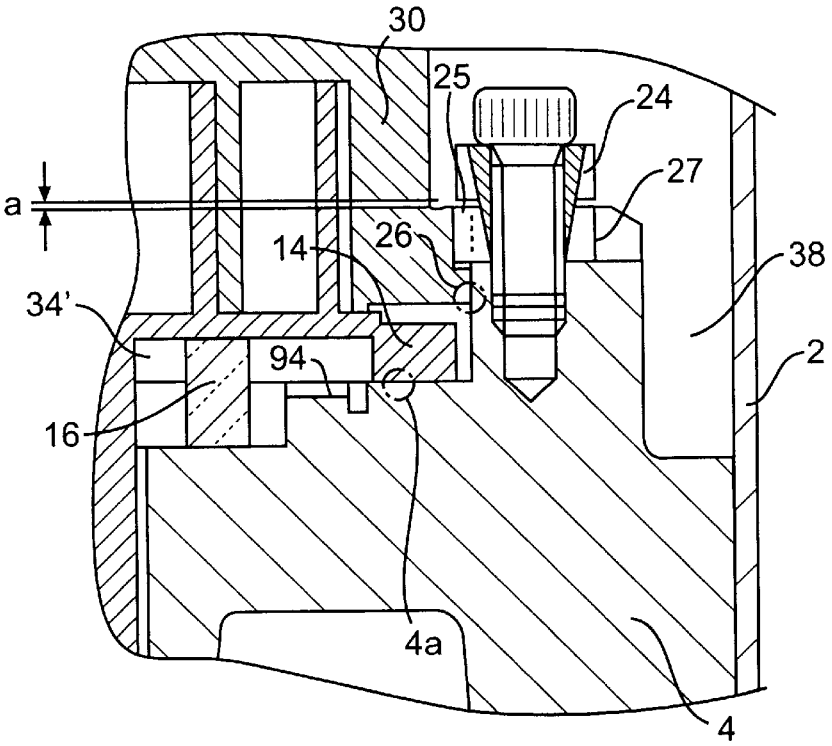
FIG. 20 displays the non-orbiting scroll situated in the frame and being secured by anti-rotating blocks.
Figure 21:
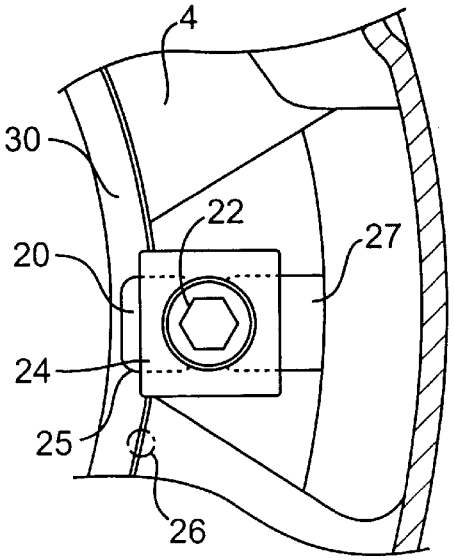
FIG. 21 is a top planar view of the anti-rotating block as it is assembled in the upper frame.

As shown in FIGS. 3, 4(*a*), 20 and 21, the frame 4 has a series of grooves 27 located about its perimeter. These grooves 27 are aligned with slots 25 formed in the end plate of the non-orbiting scroll plate 20. Two or more blocks 24 are inserted into the grooves 27 and extend into the slots 25 to prevent undesired radial and rotational displacement of the non-orbiting scroll plate. As can be seen in FIGS. 20 and 21, the block 24 extends into the groove 25 on the non-orbiting scroll plate, where it abuts against the internal wall of the groove. The block, in turn, is prevented from radial displacement by the bolt 22 which extends therethrough. Thus the block abuts against the scroll, and the holds the in place to prevent radial movement of the scroll plate. For example, in FIG. 20, the scroll plate is prevented from moving to the right by the block and the bolt. The blocks also prevent axial displacement of the non-orbiting scroll plate greater than a desired value. The relative height, h, of the block and the depth, d, of the slots are dimensioned so that the desired value of axial displacement, a, is equal to the difference between the depth of the slot on the non-orbiting scroll plate and the height of the block (See FIG. 20). The value of axial displacement, a, decreases the friction of the wraps at start up and therefore decreases the torque necessary to start the compressor.

The blocks 24 act on the outer edge of the non-orbiting scroll to prevent excess displacement. This portion of the non-orbiting scroll is not a sealing surface, and therefore mechanical wear and other damage is less likely to adversely affect the performance and service life of the compressor. In contrast, the portion of the pressure partition 66 adjacent to the non-orbiting scroll 20 is generally machined to a high tolerance to better maintain the integrity of the seals 62, 64 preventing leaking between the regions of different pressures. If this portion of the pressure partition comes into contact with the non-orbiting scroll, the sealing surfaces may become scratched, dented, or chipped, potentially adversely affecting the integrity of the seals. Preferably, the displacement, a, is small enough so that seals 130 will always provide adequate sealing between the regions of different pressures, but large enough so that the metal surfaces of the non-orbiting scroll and the pressure partition do not contact.

In this manner, the non-orbiting scroll plate can axially displace, the side walls of the slots sliding along the side walls of the blocks 24, so that the compressor may operate more efficiently. The non-orbiting scroll plate may also move slightly in the radial direction or even slightly rotate to absorb forces in these directions and adjust in response to thermally induced stresses that may be created during the operation of the compressor. The blocks, however, are dimensioned so that displacement in these directions greater than the desired displacement is prevented. This configuration allows assembly without low tolerance, expensive bolts that may complicate the assembly process. For example, the abutment portion of the block 24*a* may be provided to eliminate the need for precisely dimensioned bolts by defining a maximum distance that the bolt can be inserted into the frame. Thus, the bolts can be simply inserted into the frame without the need for precise assembling machinery.

The block configuration also eliminates the need for a large flange on the non-orbiting scroll for bolting to the frame. This creates a large sliding surface area between the non-orbiting scroll plate and the frame thereby minimizing tilting during operation.

Figure 32:
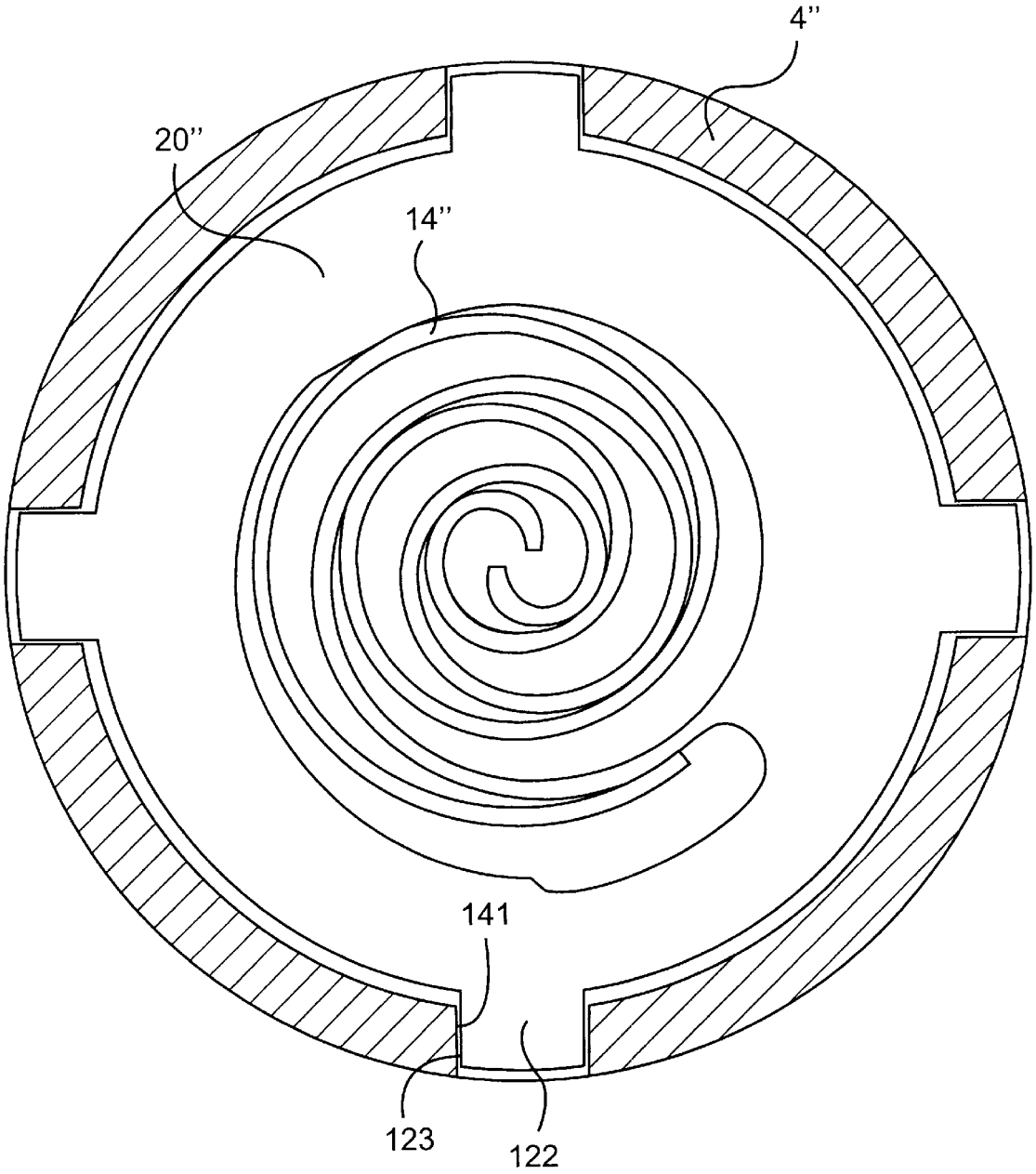
FIG. 32 is a top view of a non-orbiting scroll plate assembled in the upper frame according another non-orbiting scroll plate securing system.

Another scroll plate assembly is illustrated in FIG. 32. The upper frame 4" has a plurality of key ways 123 formed at equal spacings about the perimeter of the frame's interior surface. The non-orbiting scroll plate 20" has a plurality of slide keys 122 located at peripheral positions corresponding to the key ways 123. Each key 122 preferably has a height and width less than the depth and width of the corresponding key way 123. In this manner, the non-orbiting scroll plate can axially displace, the side walls 141 of the keys 122 sliding along the side walls of the key ways 123, so that the compressor may operate more efficiently. The non-orbiting scroll plate may also move slightly in the radial direction or even slightly rotate to absorb forces in these directions and adjust in response to thermally induced stresses that may be created during the operation of the compressor. The extent of the displacement may be determined by the respective sizes of the keys and key ways. For example, the desired value of axial displacement may equal to the difference between the depth of the key way 123 and the height of the key 122. This configuration allows assembly without bolts that may require low tolerances and complicate the assembly process.

In this embodiment, the starting torque is also reduced because static friction and inertia are reduced.

An abutment member may be provided to prevent axial displacement of the non-orbiting scroll plate 20" greater than the desired value. Preferably, the abutment is provided by part of the pressure partition 66". For example, the portion of the pressure partition 161 adjacent to the interface between the discharge ports 60" and the holes 162 in the pressure partition 66" can be used to define a maximum displacement of the non-orbiting scroll 20" by abutting against the corresponding portion 131 of the non-orbiting scroll. These portions, 131 and 161, are not sealing surfaces, and therefore mechanical wear and other damage is less likely to adversely affect the performance and service life of the compressor.

During operation, unexpected pressure variations may be created in the crescent shaped pocket or the back pressure pocket 58" causing the non-orbiting scroll plate 20" to "jump." The abutment surface prevents the "jump" from exceeding a certain displacement and thereby prevents scratching or chipping of the sealing surfaces in the region of the seals.

Figure 28:
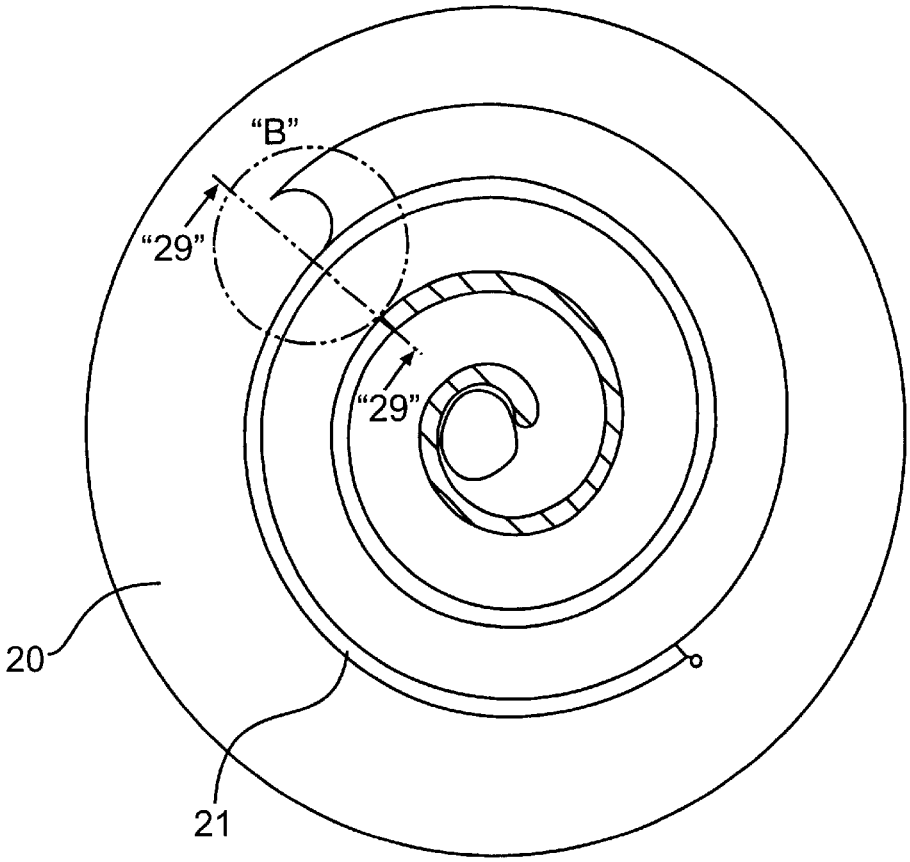
FIG. 28 is a top planar view of a scroll plate.
Figure 29:
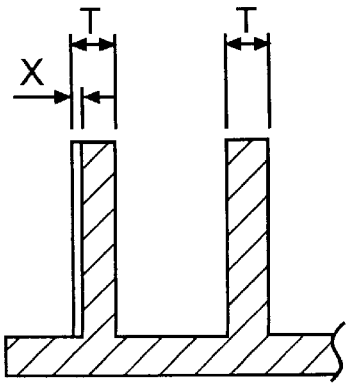
FIG. 29 is a horizontal sectional view of the scroll plate.
Figure 30:
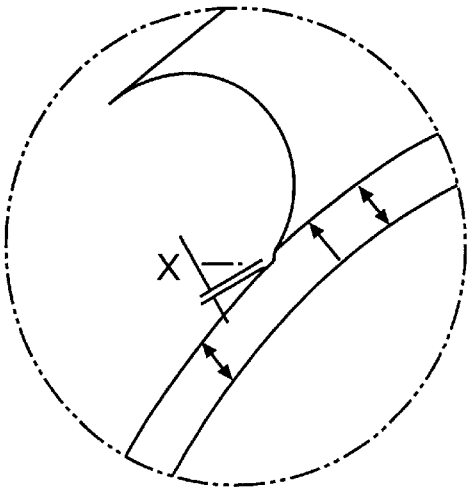
FIG. 30 is a view enlarged along the circle B on the FIG. 29.
Figure 31:
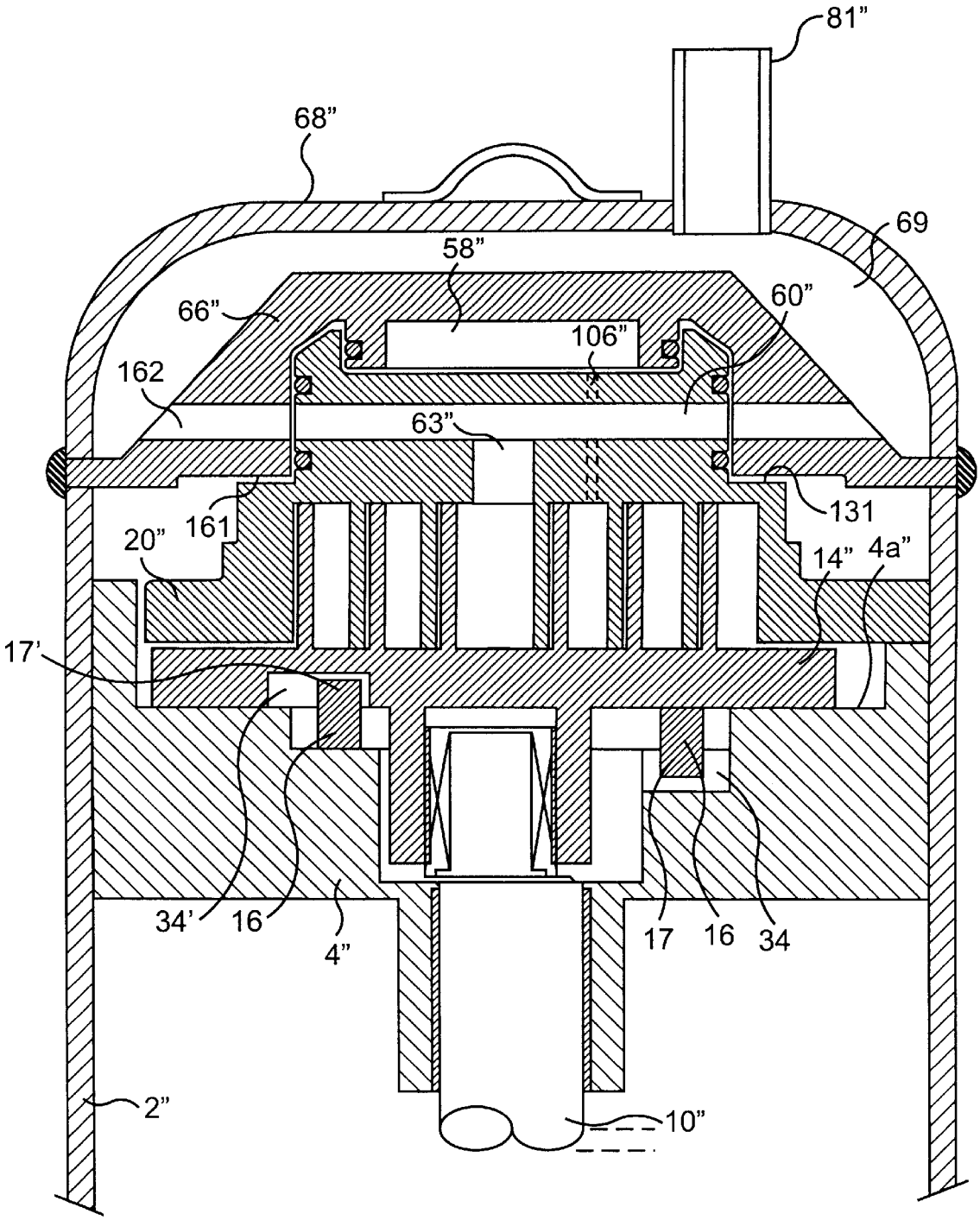
FIG. 31 illustrates a scroll-type compressor according to another embodiment of the present invention.

FIGS. 28–30 illustrate a scroll plate for use in a scroll-type fluid compressor in which the portion of the spiral shaped wrap located at the inner region of the end plate has a greater wall thickness than the portion of the spiral shaped wrap located at the outer region of the end plate. Because high fluid compression forces are not experienced at the outer region of the scrolls, the wrap thickness can be decreased without interfering with the efficiency of the compressor. Consequently, finishing time is decreased because fine finishing is not necessary. The thin wrap walls also decrease the moment of inertia of the scroll plate and increase suction fluid displacement.

The lubrication system of the present invention minimizes the lubricating path thereby reducing the motor break power and improving the efficiency of the compressor. An embodiment is illustrated in FIGS. 1, 2, 12, 15, and 16. A suction inlet 37 extends through the hermetic casing of the compressor and terminates adjacent to the frame 4. As the working fluid enters through the suction inlet 37 and contacts the frame 4, any oil entrained in the working fluid is separated, and the working fluid is directed immediately into the scrolls. The frame also cools the returning working fluid thereby improving the volumetric efficiency of the compressor.

An oil return hole 42 extends from the vicinity of the suction inlet to direct oil to an oil sump 12 at the base of the compressor. The return hole can be a hole drilled in the frame as shown at the right side of FIG. 2, or it may simply be a space that exists between the frame and the casing as shown at the left side of FIG. 2 where the passage 92 terminates. Magnets 98 are preferably located in the oil sump 12 and segregate metallic debris from the oil which may cause damage and premature wear to the scroll wraps and other components of the compressor.

Figure 25:
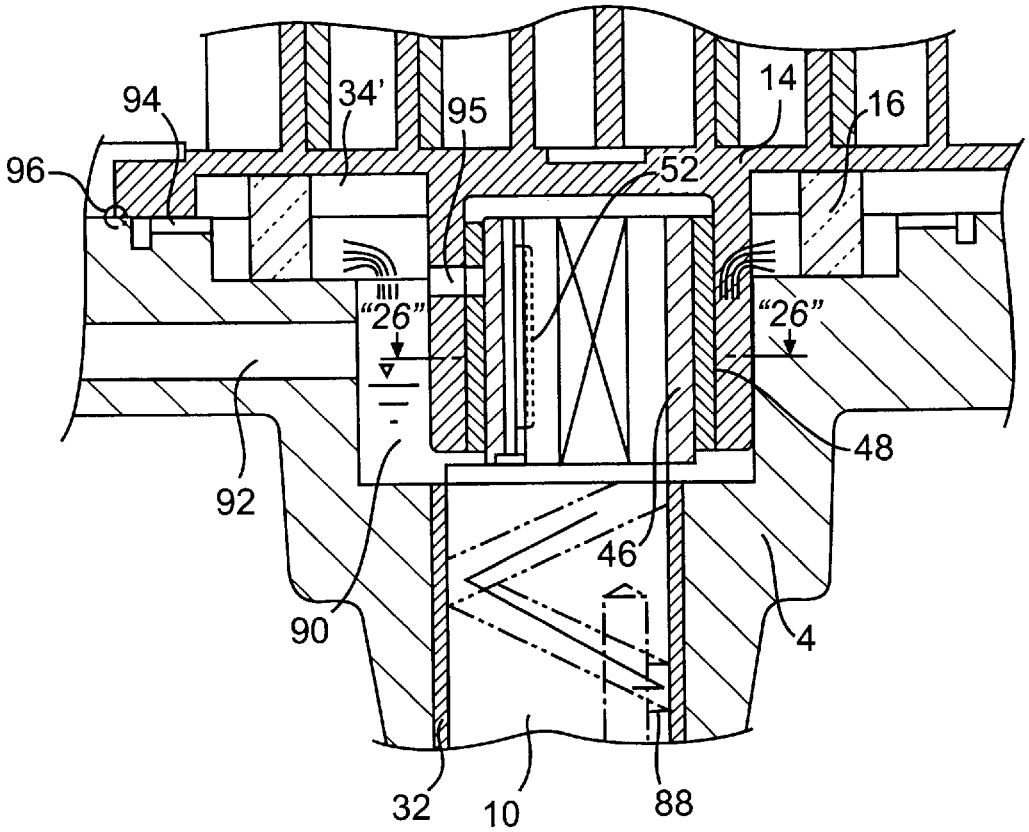
FIG. 25 is a sectional view illustrating the lubricating system around the shaft.
Figure 26:
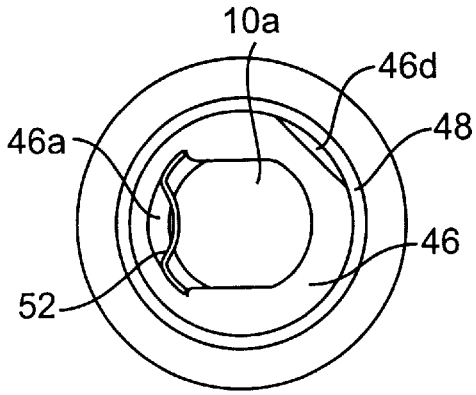
FIG. 26 is a sectional view along the line 26—26 in FIG. 25.
Figure 27:
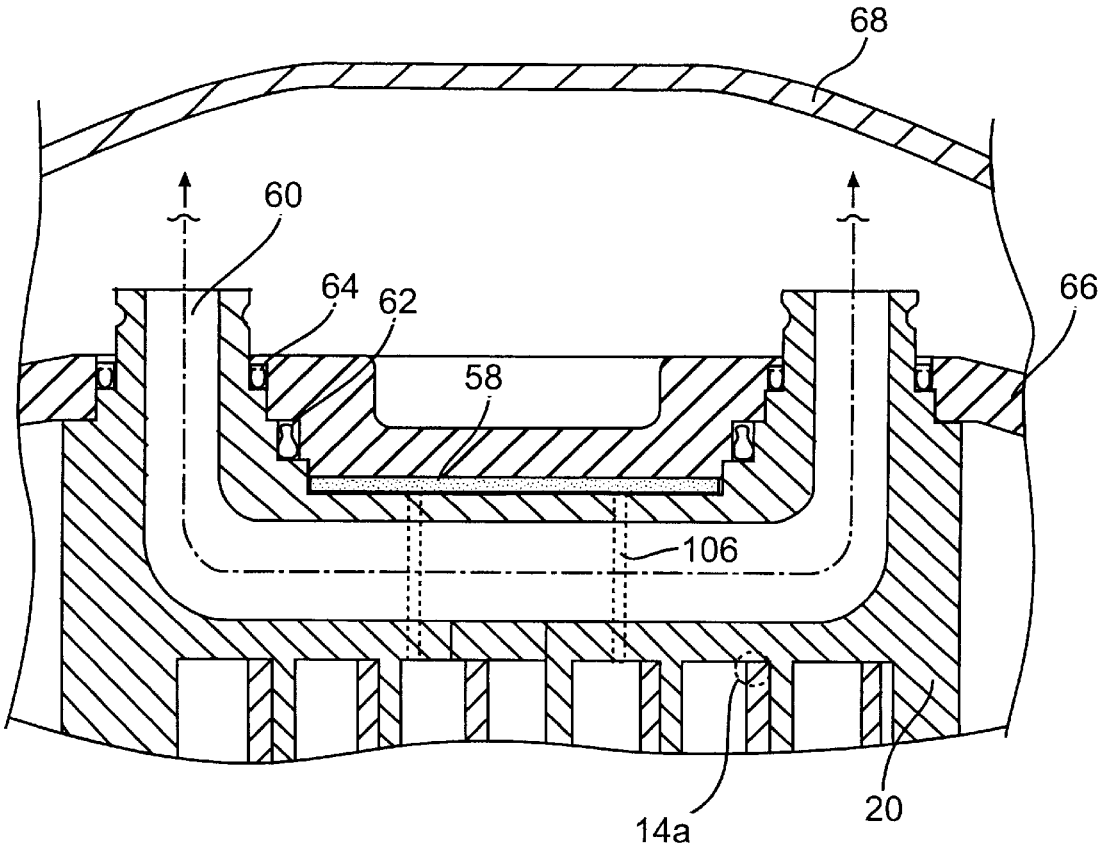
FIG. 27 is a vertical sectional view of a back pressure pocket and seals.

The shaft 10 has a radially offset oil passage 34 located therein for pumping the oil in the sump through the shaft and into the region of the scroll plates. In order to control the quantity of oil and to separate any remaining refrigerant from the oil, return passages 41 may be formed in the top and bottom of the shaft 10. Centrifugal forces resulting from the off-center location of the passage direct the oil up the oil passage against the force of gravity. Referring to FIG. 25, the shaft extends up from the sump to the region of the scroll plates through a bearing 32 in the frame 4 where the offset oil 34 passage terminates in a groove 88 at the interface between the bearing 32 and the shaft 10 to provide lubrication between the bearing 32 and the shaft 10. The groove 88 is preferably a spiral groove formed in the shaft 10 and extending from the offset oil passage 34 to an oil pocket 90 located between the frame 4 and the orbiting scroll plate 14. The groove 88 may also continue up into the bearing 48 of the orbiting scroll.

Bearing 32 maintains the proper alignment and rotation of the shaft 10 against the high inertia of the scroll plate's orbiting movement and the tilting and axial forces that are generated during operation of the compressor.

The shaft 10 continues through the bearing 32 until it terminates in a central hub of the orbiting scroll plate 10. The central hub has a hole 95 formed therein to provide an oil passage from the shaft 10 to the oil pocket 90, thereby expelling any excess oil in the region of the radial coupling 46 and the bearing 48. An oil groove 94 extends under the orbiting scroll bringing oil from the oil pocket thereby creating a lubricating thin film to cool and reduce friction between the orbiting scroll and the frame. A horizontal oil return hole 92 in the frame is connected to the oil pocket 90 to allow excess oil to return to the oil sump. This prevents excess oil from accumulating in the oil pocket 90 and interfering with the operation of the compressor. This lubrication system is simpler in design and easier to install than conventional lubrication systems.

It will be apparent to those skilled in the art that various modifications and variations can be made in the disclosed process and product without departing from the scope or spirit of the invention. Other embodiments of the invention will be apparent to those skilled in the art from consideration of the specification and practice of the invention disclosed herein. It is intended that the specification and examples be considered as exemplary only.

As would be clear to those skilled in the art, the inventive compressor can be used to produce a relatively high pressure output and/or be used to produce a vacuum or other low pressure output, depending on whether the high or low pressure side of the compressor is connected to the relevant equipment. The term compressor as used herein includes, but is not limited to, scroll devices such as pumps, expanders, or engines.

What is claimed is:

1. A scroll-type fluid compressor, comprising a frame having a groove located thereon;

a non-orbiting scroll plate having an end plate on which a spiral shaped wrap is located and a slot aligned with said frame groove;

an orbiting scroll plate having an end plate on which a spiral shaped wrap is located; said orbiting and non-orbiting scroll plates being arranged to interfit said spiral shaped wraps thereby defining an interior space comprising a series of movable, crescent shaped pockets which reduce in volume as they move radially inwardly towards a center point during an orbiting cycle in which the orbiting scroll plate orbits relative to the non-orbiting scroll plate; and a block in said groove and said slot to prevent undesired radial and rotational displacement of the non-orbiting scroll plate.

2. The scroll-type fluid compressor of claim 1, wherein said block includes an abutment surface adjacent to said non-orbiting scroll plate that permits some axial displacement of the non-orbiting scroll plate, but prevents axial displacement of the non-orbiting scroll plate greater than a desired value.

3. The scroll-type fluid compressor of claim 2, wherein the desired value of axial displacement is equal to the difference between the depth of the slot on the non-orbiting scroll plate and the height of the block.

4. The scroll-type fluid compressor of claim 1, including a back pressure pocket formed in said non-orbiting scroll plate on the side of the end plate opposite to the spiral shaped wrap, and a pressure equalizing passage formed in said non-orbiting scroll plate at a location of intermediate pressure, the pressure equalizing passage interconnecting said back pressure pocket and said interior space.

5. The scroll-type fluid compressor of claim 4, wherein said back pressure pocket is located between said non-orbiting scroll plate and a pressure partition.

6. The scroll-type fluid compressor of claim 5, wherein a seal is located at an interface between said back pressure pocket and said pressure partition, said seal being compressed in the axial direction.

7. The scroll-type fluid compressor of claim 1, wherein said non-orbiting scroll plate further comprises a plurality of discharge ports for discharging high pressure fluid from the interior space defined by the interfitting spiral shaped wraps.

8. The scroll-type fluid compressor of claim 7, wherein each of said plurality of discharge ports includes a discharge passage radiating outwardly from a central portion of said non-orbiting scroll plate and are arranged at equal spacings.

9. The scroll-type fluid compressor of claim 8, including a check valve located at said discharge ports to prevent back-flow of fluid through the compressor.

10. The scroll-type fluid compressor of claim 9, wherein the check valve comprises a plate adapted to cover said discharge port and a housing having a discharge hole, said plate being interposed between said discharge hole and discharge port when said plate covers said discharge port.

11. The scroll-type fluid compressor of claim 1, wherein said block is located in said groove and extends into said slot to prevent undesired radial and rotational displacement of the non-orbiting scroll plate.

12. A scroll-type fluid compressor comprising:

a hermetically sealed casing being composed of an upper chamber wall, an intermediate chamber wall, and a lower chamber wall;

a non-orbiting scroll plate having an end plate on which a spiral shaped wrap is located, said non-orbiting scroll plate being housed in said casing;

an orbiting scroll plate having an end plate on which a spiral shaped wrap is located; said orbiting and non-orbiting scroll plates being arranged to interfit said spiral shaped wraps thereby defining an interior space comprising a series of movable, crescent shaped pockets which reduce in volume as they move radially inwardly towards a center point during an orbiting cycle in which the orbiting scroll plate orbits relative to the non-orbiting scroll plate; wherein an inner surface of the wall of the intermediate chamber is fitted about an outer surface of a ridge on said lower chamber wall and welded thereto by a weld bead that is formed at the joint between the wall of the intermediate chamber and the lower chamber wall.

13. The scroll-type fluid compressor of claim 12, including a back pressure pocket formed in said non-orbiting scroll plate on the side of the end plate opposite to the spiral shaped wrap, and at least one pressure equalizing passage formed in said non-orbiting scroll plate, the at least one pressure equalizing passage interconnecting said back pressure pocket and said interior space.

* * * * *